US006589035B1

(12) United States Patent
Tsubono et al.

(10) Patent No.: US 6,589,035 B1
(45) Date of Patent: Jul. 8, 2003

(54) SCROLL COMPRESSOR HAVING A VALVED BACK-PRESSURE CHAMBER AND A BYPASS FOR OVER-COMPRESSION

(75) Inventors: Isamu Tsubono, Ibaraki-ken (JP); Masahiro Takebayashi, Tsuchiura (JP); Isao Hayase, Tsuchiura (JP); Koichi Inaba, Tochigi-ken (JP); Koichi Sekiguchi, Tochigi-ken (JP); Kenichi Oshima, Tochigi-ken (JP); Atsushi Shimada, Tochigi (JP); Takehiro Akizawa, Kanuma (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 08/942,737

(22) Filed: Oct. 3, 1997

(30) Foreign Application Priority Data

Oct. 4, 1996 (JP) ..... 8-264042

(51) Int. Cl.[7] ..... F04C 18/04
(52) U.S. Cl. ..... 418/55.5; 418/15
(58) Field of Search ..... 418/55.5, 15, 57

(56) References Cited

U.S. PATENT DOCUMENTS 4,496,296 A * 1/1985 Arai et al. ..... 418/55.5
4,596,520 A * 6/1986 Arata et al. ..... 418/55.5
4,669,962 A * 6/1987 Mizuno et al. ..... 418/55.5
4,774,816 A * 10/1988 Uchikawa et al. ..... 418/15
5,082,432 A * 1/1992 Kikuchi ..... 418/55.5
5,597,296 A * 1/1997 Akazawa et al. ..... 418/55.1
5,762,483 A * 6/1998 Lifson et al. ..... 418/55.5
5,823,757 A * 10/1998 Kim ..... 418/55.5

FOREIGN PATENT DOCUMENTS

JP 57-76291 * 5/1982
JP 58-128485 * 8/1983
JP 5-187370 * 7/1993 ..... 418/55.5
JP 6-26470 * 2/1994 ..... 418/57

OTHER PUBLICATIONS

Japanese Patent Examined Publication No. 2–60873.
Japanese Patent Unexamined Publication No. 58–128485.

* cited by examiner

*Primary Examiner*—John J. Vrablik
(74) *Attorney, Agent, or Firm*—Antonelli, Terry, Stout & Kraus, LLP

(57) ABSTRACT

There is provided a scroll compressor having high overall efficiency and reliability in a wide pressure operating range. A backside excess-suction-pressure region is provided such that pressure higher than suction pressure by a constant value is applied to a backside of scroll members to produce an attractive force to attract both scroll members. A control bypass is also provided for communicating compression chambers with a discharge system only when pressure in the compression chambers is high.

14 Claims, 21 Drawing Sheets

SCROLL COMPRESSOR HAVING A VALVED BACK-PRESSURE CHAMBER AND A BYPASS FOR OVER-COMPRESSION

BACKGROUND OF THE INVENTION

1. Field of the Invention

The present invention relates to a scroll compressor.

2. Related Art

To reduce the axial gas force (pull-off force) that separates a fixed scroll and an orbiting scroll from each other along a direction of a main shaft which is generated by the compression action of both scrolls, pressure intermediate between discharge pressure and intake pressure is introduced into the backside of the orbiting scroll to produce an attractive force to cancel the pull-off force. Since the intermediate pressure is proportional to the intake pressure, the following problem arises. For example, a shift from a high rotational speed to a low rotational speed causes excess back pressure and hence a large thrust between the orbiting scroll and the fixed scroll. Consequently, sliding friction at top and bottom of each wrap increases to reduce the mechanical efficiency.

In order to solve the problem, Japanese Patent published Application (JP-B) No. 2-60873 (document 1) discloses a scroll compressor in which a back-pressure chamber and an intake space communicate with each other through a valve. Such a structure is provided to let the excess pressure escape.

The pull-off force is determined by a number of factors. One is a pressure distribution of fluid in the compression chambers defined by the orbiting scroll and the fixed scroll while the other is a discharge pressure i.e., a pressure of fluid in a discharge chamber. Since the axial project area of the discharge chamber is smaller than that of all the regions on the side of compression chambers (i.e., the area of a compression chamber which is about to communicate with a discharge port is smaller than the sum of areas of the other compression chambers), except in the case that the number of turns for the scroll wraps is extremely small, the advantage of the discharge pressure on the pull-off force can be omitted to provide a first order approximation. Further, since the compression ratio of the scroll compressor is predetermined in design, the pressure distribution of fluid in the compression chambers (intensity of pressure in individual compression chambers) will substantially depend on suction pressure alone unless an extremely large internal leakage occurs. It is apparent from the above that the pull-off force is generally determined by the suction pressure alone.

On the other hand, the attractive force is exerted for attracting both end plates against the pull-off force. The magnitude of the attractive force is preferably kept at the same level as that of the pull-off force at all times from the standpoint of load-deformation of the scroll members. Although an energizing force exerted between the scroll member and an associated support member is also made small, if relative motion is given therebetween, the danger of friction loss and wear can be reduced. From this point, it is also preferable to keep the attractive force at the same level as that of the pull-off force at all times.

However, since a force from fluid and a centrifugal force are practically imparted to the scroll members in a direction perpendicular to the axis, the attractive force must also resist the inclination moment produced by such forces. For this reason, the attractive force is ideally controlled to be able to attract the end plates of the scroll members with minimum magnitude, but such control can not be realized except in special cases because of an increase in cost.

Therefore, a practical means for applying attractive force has a relatively simple mechanism such that it can realize a force which comprises the pull-off force and a force that can resist the inclination moment throughout the operating range required. As discussed above, since the pull-off force is substantially determined by the suction pressure alone, it is reasonable to provide the attractive force applying means with a mechanism that depends on the suction pressure.

The above document 1 teaches a concrete technique for generating an attractive force by providing a backside excess-suction-pressure region having a pressure dependent on the suction pressure plus a constant value (excess suction pressure value). The scroll compressor is a compressor having a constant capacity ratio. Therefore, as the suction pressure increases, the pressure in compression chambers becomes high in proportion thereto and consequently, the pull-off force increases. Stated more specifically, when the suction pressure increases several times, the pull-off force also increases several times, i.e., by the same factor. In other words, the pull-off force becomes large under the condition that the suction pressure is high. The largest value of the excess suction pressure is thus required in such a condition, and the value is used as the excess suction pressure value in the compressor.

A rated condition in which high performance and reliability are required due to frequent operation is set at about a center of the operating range, and, therefore, the suction pressure also becomes about a center of the range of suction pressure required by operation. For this reason, the suction pressure under the rated condition is extremely different in intensity from the suction pressure with the excess suction pressure value determined for the compressor. In such a case, an excess attractive force causes an increased energizing force between the fixed scroll member and the orbiting scroll member under the rated conditions, so that the danger of sliding friction loss and wear increases to reduce the performance and the reliability.

SUMMARY OF THE INVENTION

It is an object of the present invention to provide a scroll compressor that shows small variations of attractive force throughout the operating range.

The above object of the present invention is achieved by a scroll compressor comprising: an orbiting scroll; a fixed scroll meshed with the orbiting scroll; a back-pressure chamber provided at the backside of the orbiting scroll; a path for introducing fluid into the back-pressure chamber; a communication path between the back-pressure chamber and an intake pressure region; means for opening and closing the communication path in response to the difference between the pressure in the back-pressure chamber and the intake pressure; a communication hole communicating a compression chamber that is not communicating with a discharge port and that is defined by said orbiting scroll and said fixed scroll with a space outside of said compression chamber; a discharged-side space into which the fluid flows from the discharge port; a space interconnecting said space outside of said compression chamber and said discharged-side space; and means provided in said communication hole for opening and closing said communication hole.

The above object of the present invention is also achieved by a scroll compressor comprising: an orbiting scroll member having an end plate and a spiral scroll wrap provided on the end plate; a fixed scroll member having an end plate and a spiral scroll wrap provided on the end plate, which is meshed with the orbiting scroll member; means for applying an attractive force to each scroll member, the attractive force acting to attract the end plates of both scroll members against a pull-off force to separate the end plates of both scroll members by pressure of fluid in compression chambers defined by both scroll members meshed with each other; a scroll support member for producing a reaction force of an energizing force, the reaction force being determined by a difference between the attractive force and the pull-off force; a suction system for introducing fluid into the compression chambers; a discharge system for discharging the compressed fluid from the compression chambers to the outside; a control bypass for communicating the compression chambers with said discharge system when the pressure in the compression chambers is higher than discharge pressure,i.e., pressure in said discharge system.

Further, the above object of the present invention is achieved by a scroll compressor comprising: an orbiting scroll member having an end plate and a spiral scroll wrap provided on the end plate; a fixed scroll member having an end plate and a spiral scroll wrap provided on the end plate, which is meshed with the orbiting scroll member; means for applying an attractive force to each scroll member, the attractive force acting to attract the end plates of both scroll members against a pull-off force to separate the end plates of both scroll members from each other by pressure of fluid in compression chambers defined by both scroll members meshed with each other; a scroll support member for producing an reaction force of an energizing force, the reaction force being determined by a difference between the attractive force and the pull-off force; a suction system for introducing fluid into the compression chambers; and a discharge system for discharging the compressed fluid from the compression chambers to the outside, wherein said orbiting scroll member is used for said scroll support member of said fixed scroll member, said attractive force applying means applies pressure to a backside excess-suction-pressure region provided at the backside of said fixed scroll, the pressure to be applied being higher than suction pressure in the suction system, and a control bypass is provided for communicating the compression chambers with said discharge system when the pressure in the compression chambers is higher than the discharge pressure in said discharge system.

BRIEF DESCRIPTION OF THE DRAWINGS

The above and other objects and advantages and further description will now be discussed in connection with the drawings, in which.

DESCRIPTION OF THE PREFERRED EMBODIMENTS

Referring to FIG. 1 and FIGS. 3 through 16, a first embodiment of the present invention will be described. The first embodiment embodies the present invention in an orbiting float type horizontal scroll compressor. In the scroll compressor, a fixed scroll member is fixed to a casing. A backside excess-suction-pressure region is provided at the backside of an end plate of the orbiting scroll member, the backside located on the opposite side of compression chambers. The fixed scroll member is used for a scroll support member of the orbiting scroll member, i.e., the orbiting scroll member is pressed to the fixed scroll member under operating pressure conditions required.

Figure 1:
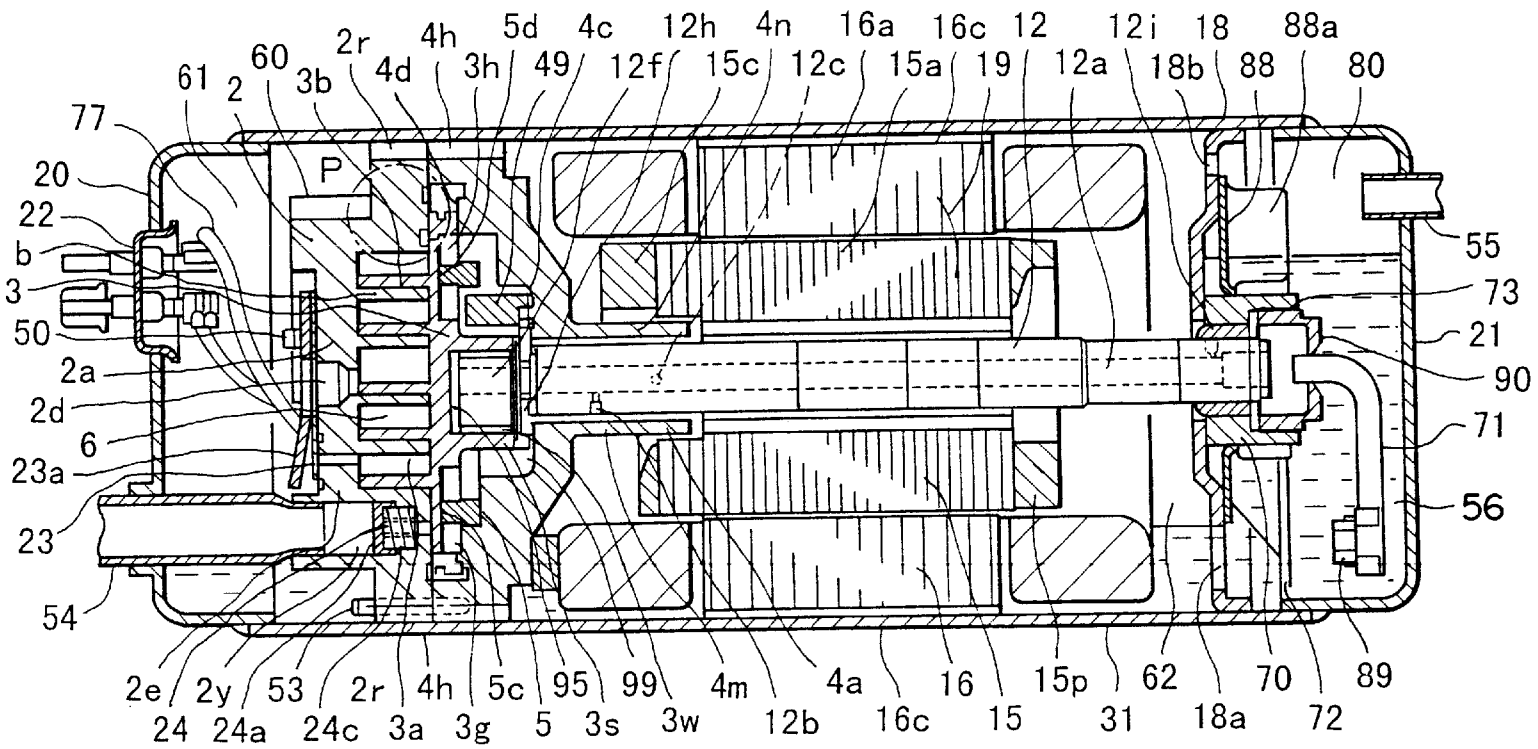
FIG. 1 is a longitudinal sectional view of a first embodiment according to the present invention.
Figure 3:
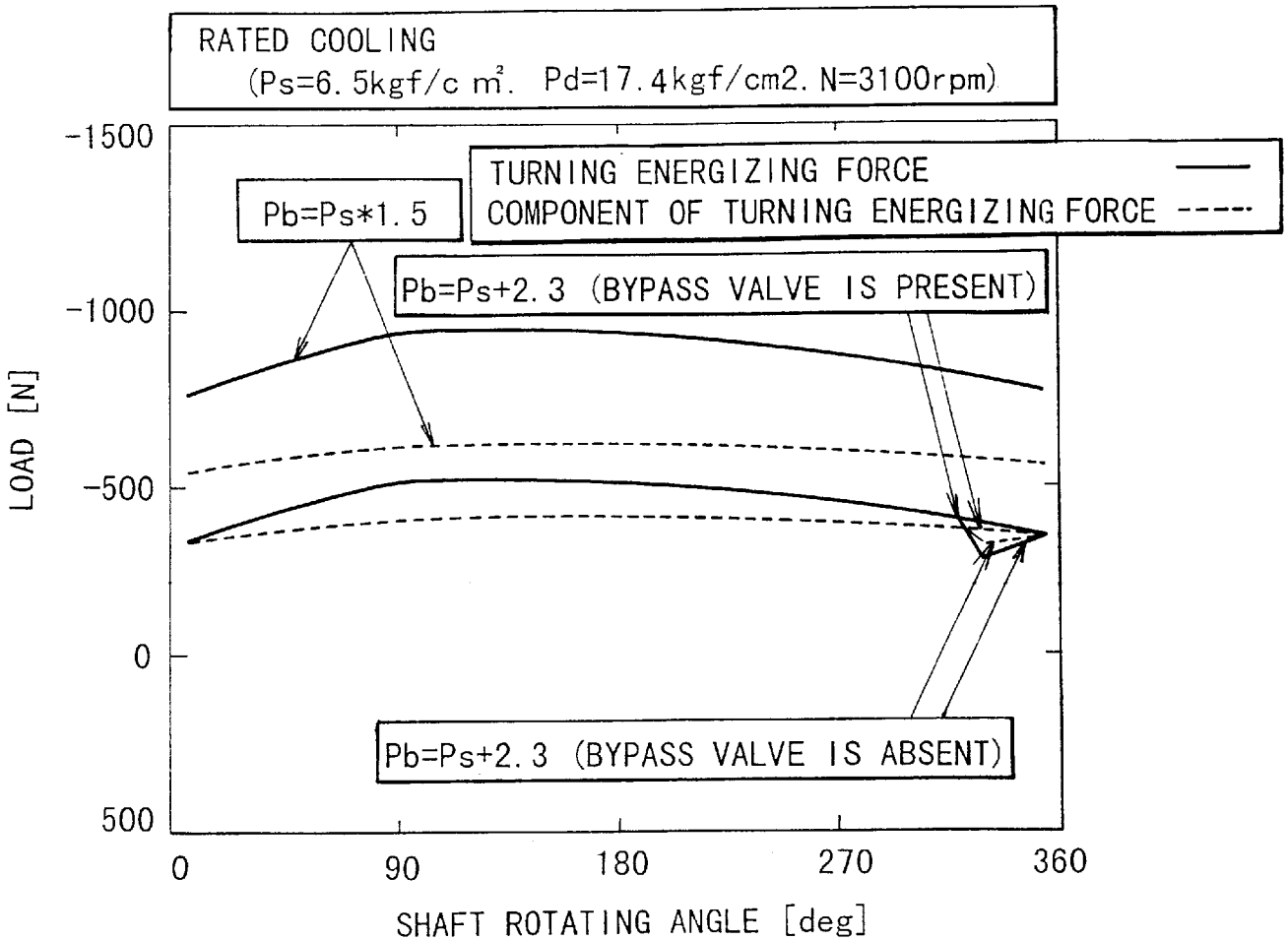
FIG. 3 is a graph showing load calculation results at a rated cooling condition of the first embodiment.
Figure 4:
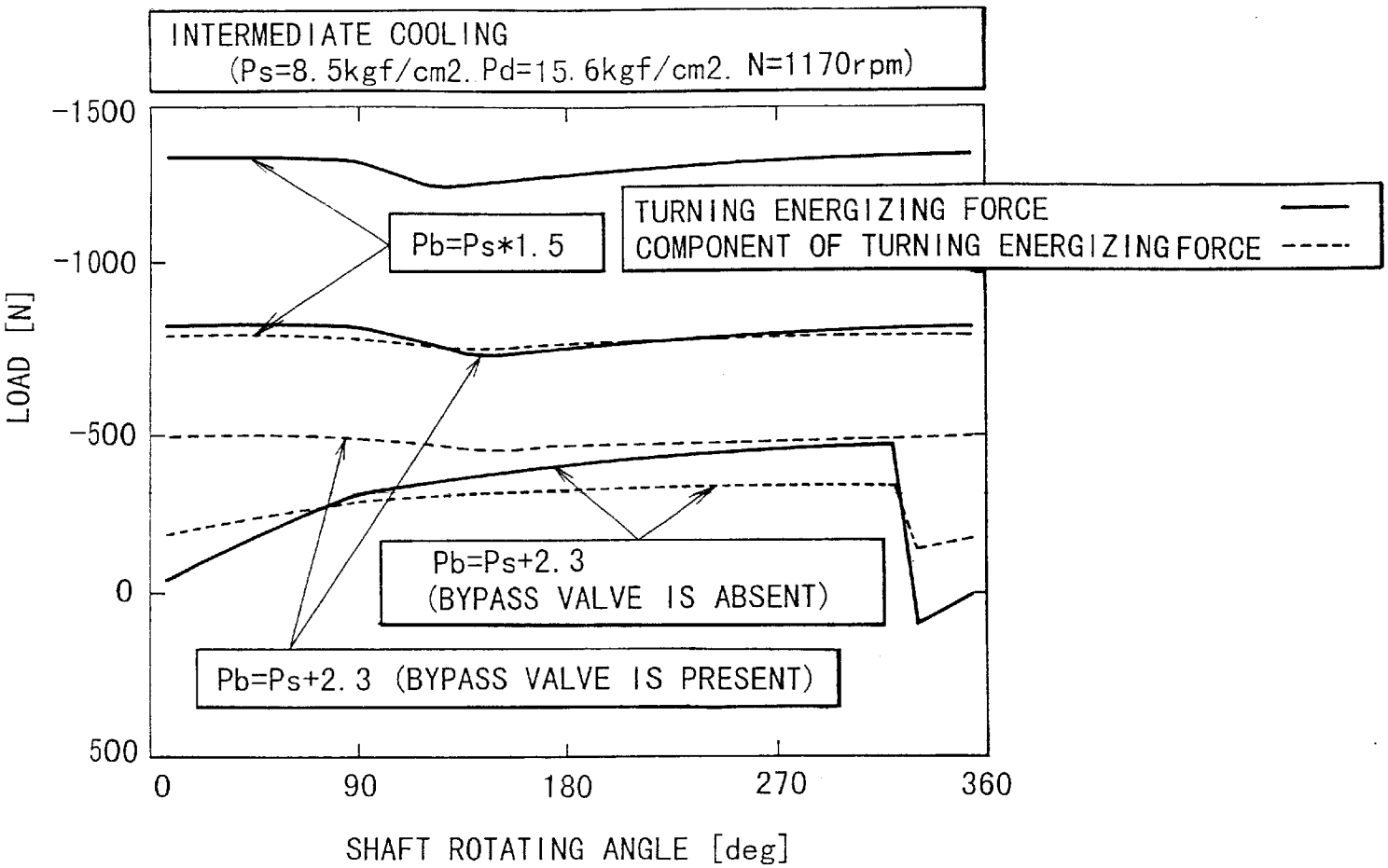
FIG. 4 is a graph showing load calculation results at an intermediate cooling condition of the first embodiment.
Figure 5:
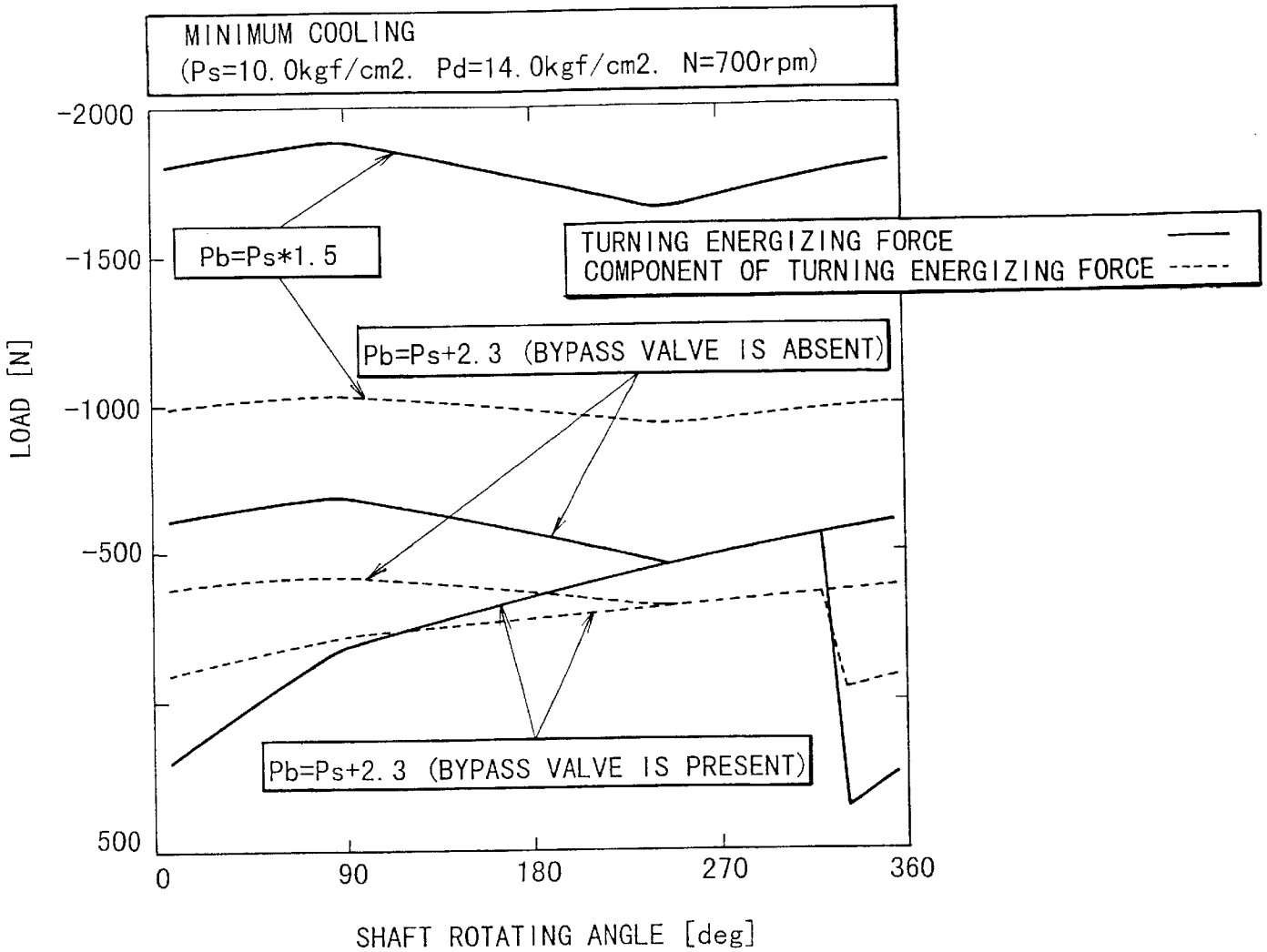
FIG. 5 is a graph showing load calculation results at a minimum cooling condition of the first embodiment.
Figure 6:
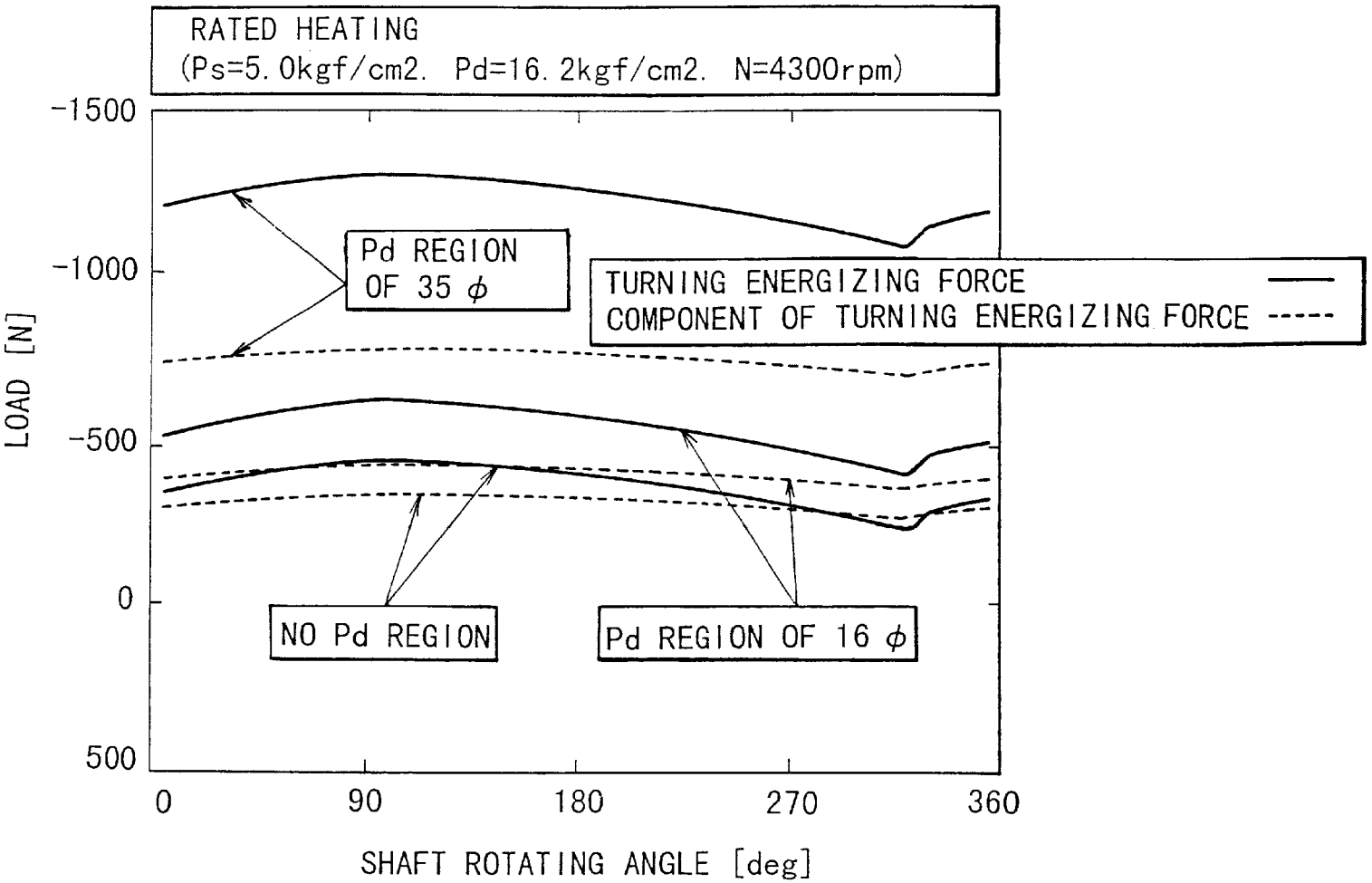
FIG. 6 is a graph showing load calculation results at a rated heating condition of the first embodiment.
Figure 7:
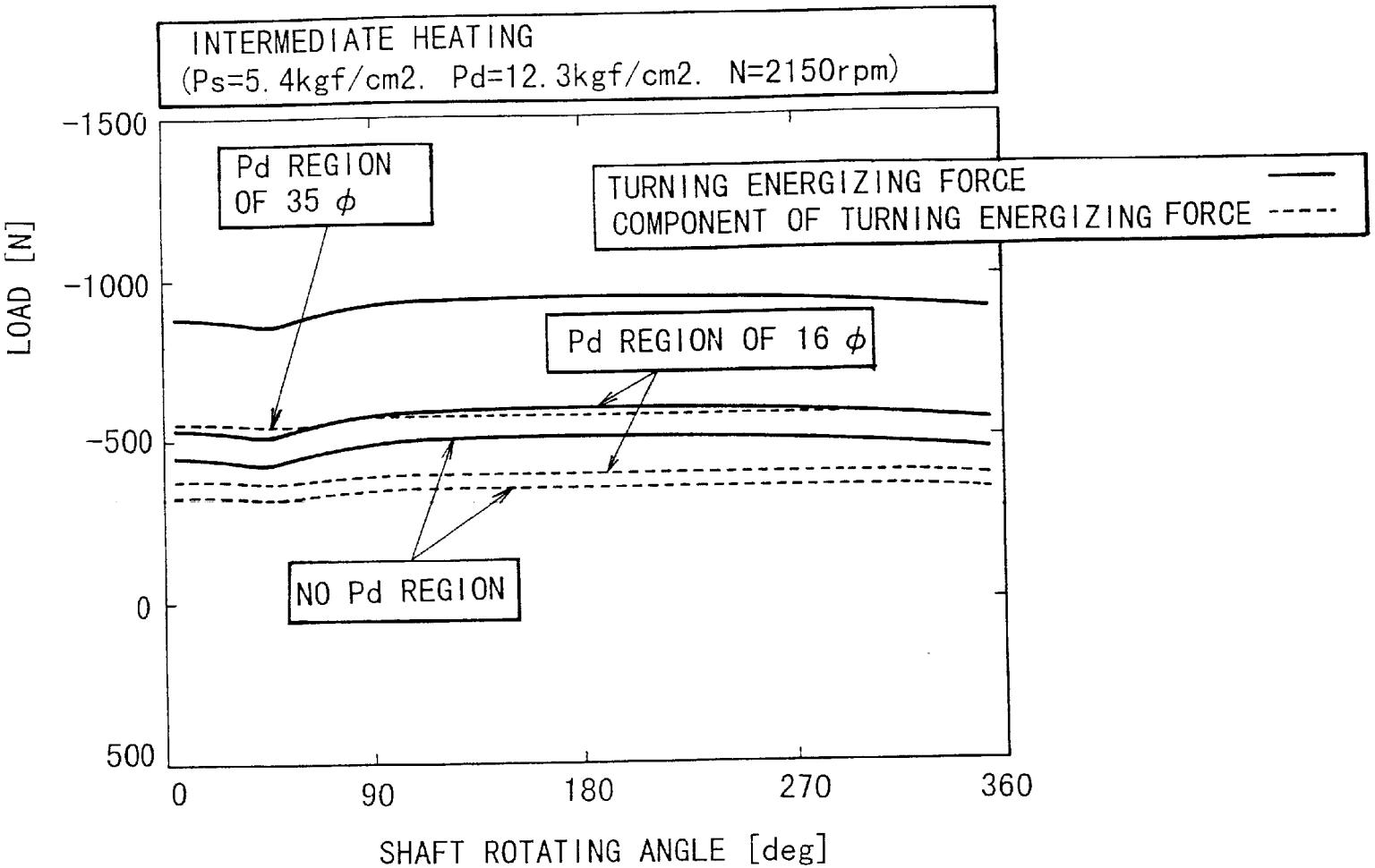
FIG. 7 is a graph showing load calculation results at an intermediate heating condition of the first embodiment.
Figure 8:
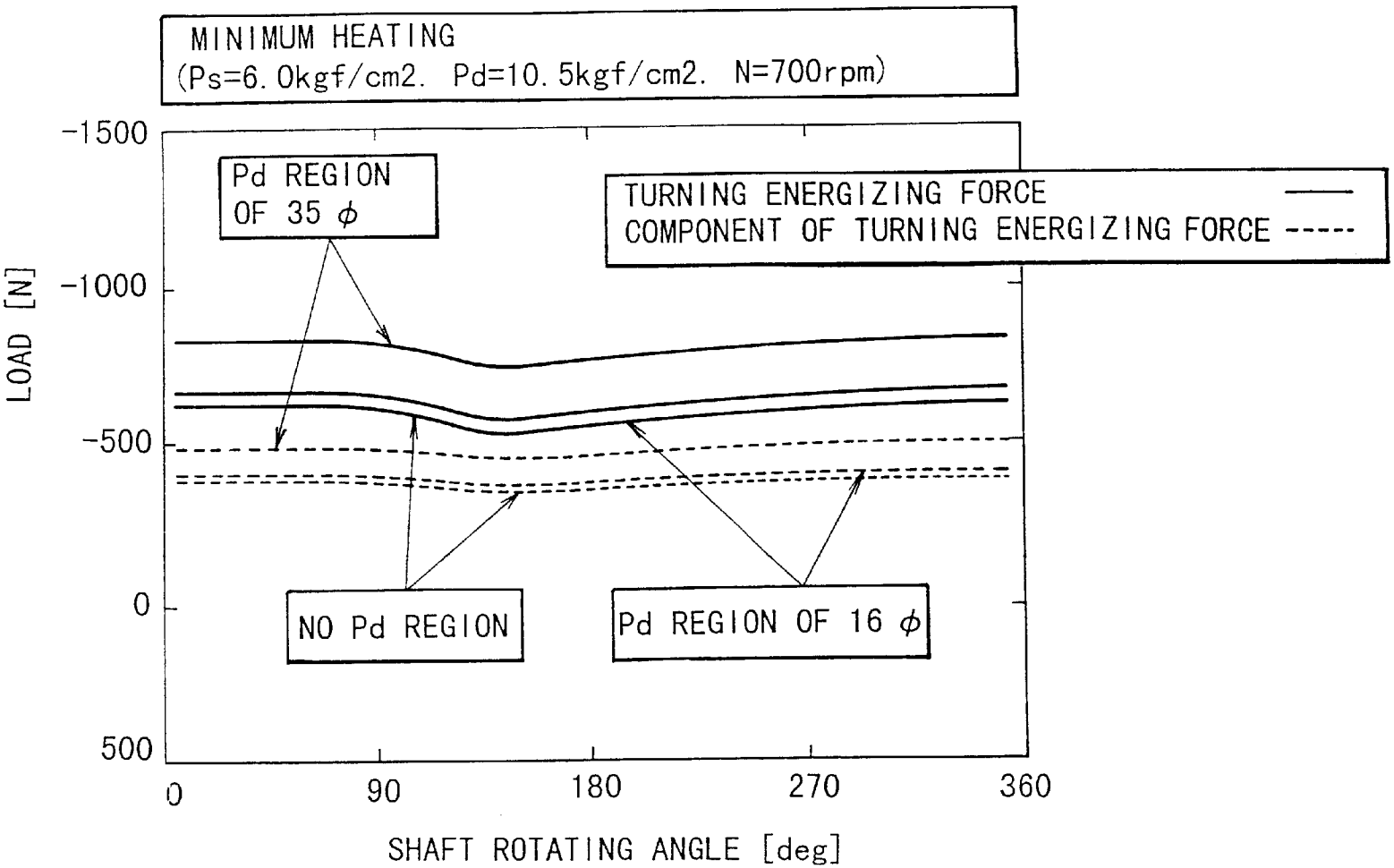
FIG. 8 is a graph showing load calculation results at a minimum heating condition of the first embodiment.
Figure 9:
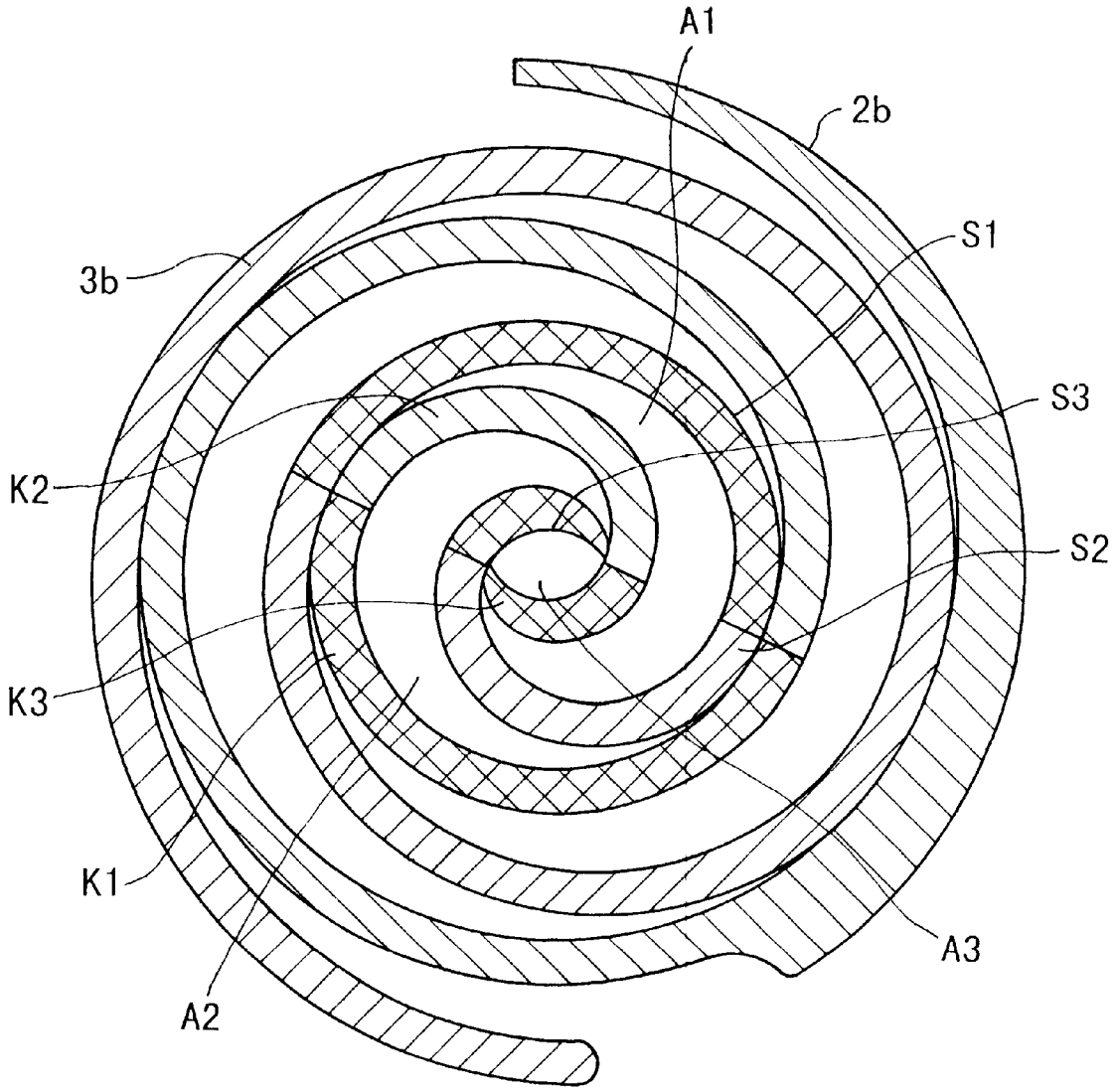
FIG. 9 is a diagram of the first embodiment, showing a region in which discharge pressure is applied.
Figure 10:
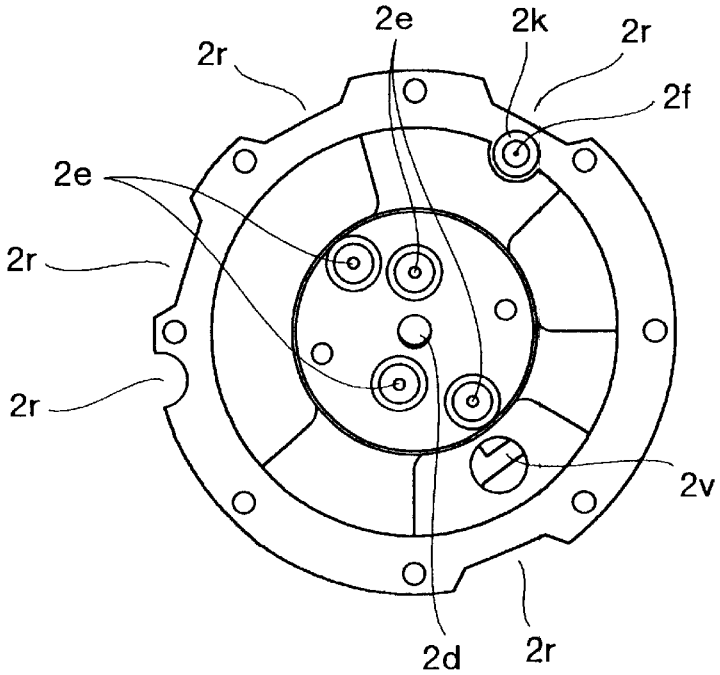
FIG. 10 is a plan view of the first embodiment when viewed from the other side of the scroll wrap of a fixed scroll member.
Figure 11:
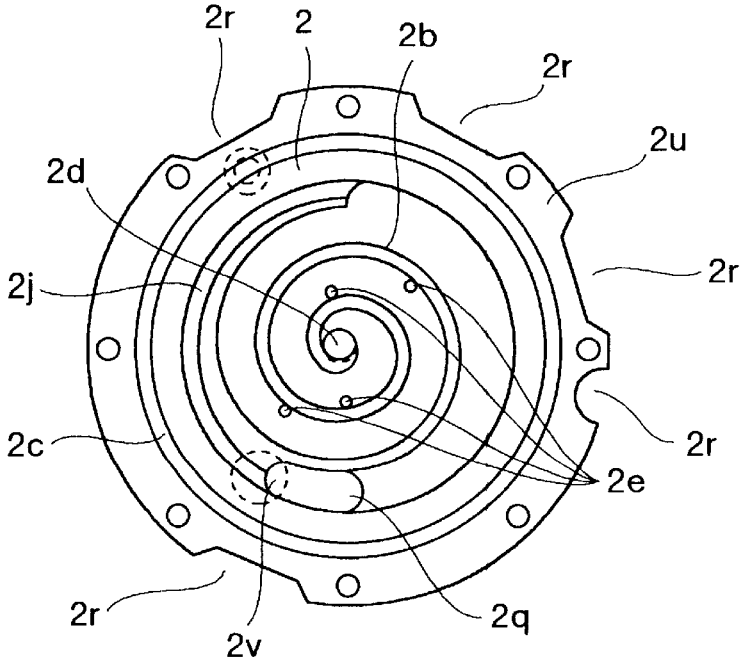
FIG. 11 is a plan view of the first embodiment, which shows the neighbor of a check valve on the suction side of the member.
Figure 12:
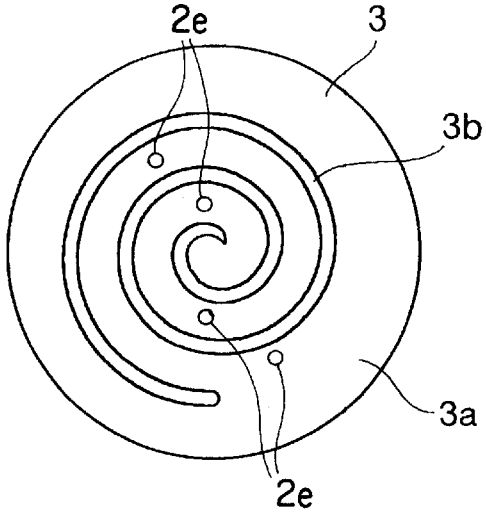
FIG. 12 is a plan view of an orbiting scroll member of the first embodiment.
Figure 13:
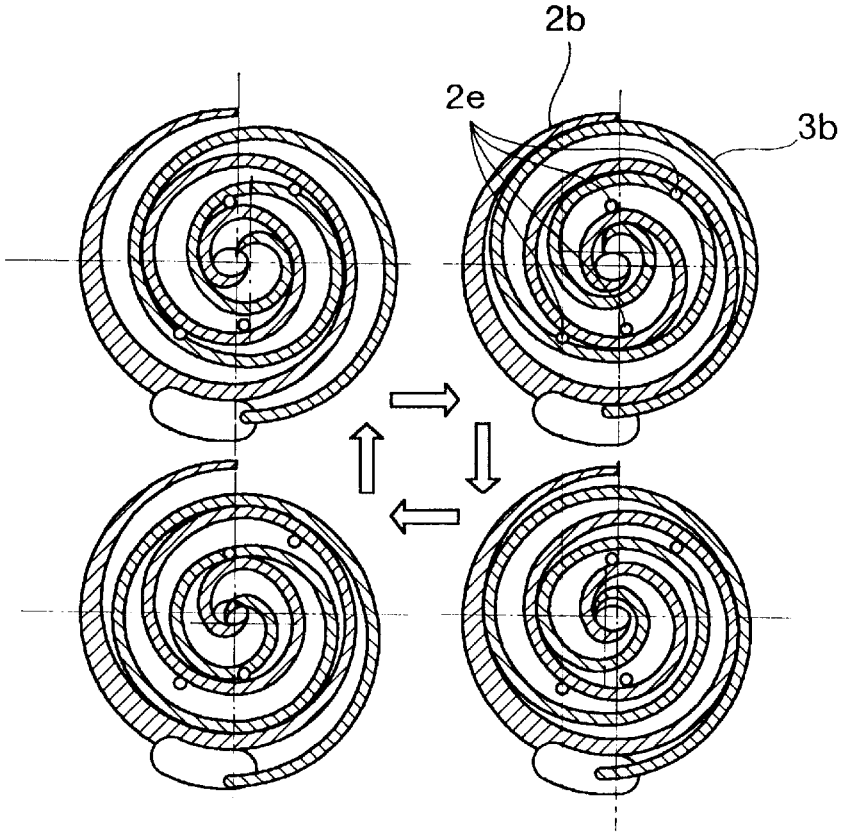
FIG. 13 is a diagram explaining the compression process of the first embodiment.
Figure 14:
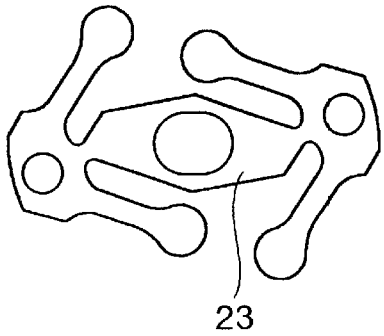
FIG. 14 is a plan view of a bypass valve plate of the first embodiment.
Figure 15:
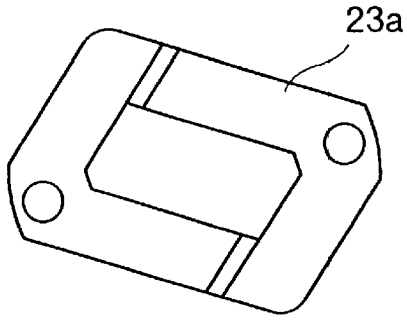
FIG. 15 is a plan view of a retainer of the bypass valve plate of the first embodiment.

FIG. 1 is a longitudinal sectional view of the compressor; FIG. 3 is a graph showing load calculation results at a rated cooling condition; FIG. 4 is a graph showing load calculation results at an intermediate cooling condition; FIG. 5 is a graph showing load calculation results at a minimum cooling condition; FIG. 6 is a graph showing load calculation results at a rated heating condition; FIG. 7 is a graph showing load calculation results at an intermediate heating condition; FIG. 8 is a graph showing load calculation results at a minimum heating condition; FIG. 9 is a diagram explaining a region in which discharge pressure is applied; FIG. 10 is a plan view viewed from the other side of the scroll wrap of the fixed scroll member; FIG. 11 is a plan view viewed from the side of the scroll wrap of the fixed scroll member; FIG. 12 is a diagram explaining a region in which discharge pressure is applied; FIG. 13 is a diagram explaining the compression process; FIG. 14 is a plan view of a bypass valve plate; FIG. 15 is a plan view of a retainer of the bypass valve plate; and FIG. 16 is a longitudinal sectional view of a pressure-difference control valve.

The construction will first be described. In FIG. 1, an orbiting scroll member 3 is constructed to have a scroll wrap 3*b* standing on an end plate 3*a*, and a bearing holder 3*s* with a bearing 3*w* inserted therein and Oldham's grooves 3*g*, 3*h* are provided at the backside. As shown in FIGS. 10 and 11, a fixed scroll member 2 has a reference surface 2*u* placed in the same plane as the top of the scroll wrap, and an inner surrounding groove 2*c* is formed on the reference surface 2*u*. Then, four bypass holes 2*e* are provided on the bottom of the scroll wrap. The reason why the four bypass holes 2*e* are provided is that the four bypass holes 2*e* always communicate with all compression chambers 6 to be formed. As shown in FIG. 1, a bypass valve plate 23 which is a lead valve plate and a retainer 23*a* for limiting opening degree of the bypass plate are fastened with a bypass screw 50 so as to cover the bypass holes 2*e*. A discharge hole 2*d* is opened near the center of the fixed scroll member 2.

A suction dig 2*q* is provided on the outer edge side of the bottom surface of the wrap, and a suction hole 2*v* is provided in the dig 2*q* for inserting a suction pipe 54 from the backside (FIGS. 10 and 11). When inserting the suction pipe 54 into the suction hole 2*v*, a valve body 24*a* and a check valve spring 24*c* are incorporated in the suction hole 2*v* to form a suction side check valve 24 (FIG. 1). A plurality of communicating grooves 2*r* are provided around the circumference of the fixed scroll member 2 for use as passages for discharge gas and oil (FIGS. 10 and 11). A valve hole 2*f* is opened from the backside toward the inner surrounding groove 2*c* with a tapered valve seal surface 2*p* provided as shown in FIGS. 10, 11 and 16. Then, a suction passage 2*i* is provided between the side of the valve hole 2*f* and a suction groove 2*j* communicating with a suction chamber.

Figure 16:
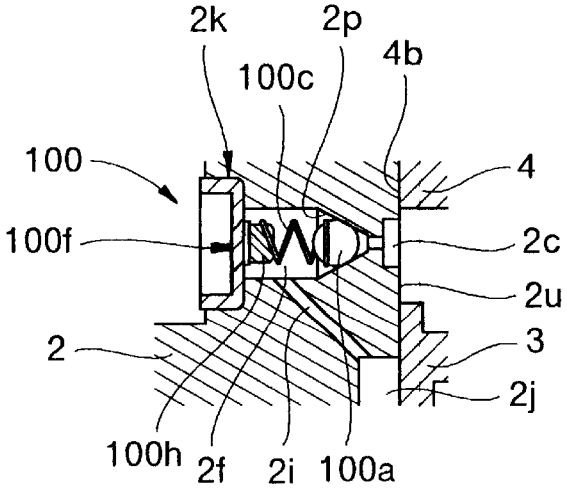
FIG. 16 is a longitudinal sectional view of the first embodiment, which shows a pressure-difference control valve (portion P in FIG. 1)

As shown in FIG. 16, a globular valve body 100*a* and a differential-pressure valve spring 100*c* are incorporated in the valve hole 2*f* with one end of the differential-pressure valve spring 100*c* inserted in a spring positioning projection 100*h*. A valve cap 100*f* is press fitted into a valve cap inserting portion 2*k* having a diameter larger than the valve hole 2*f*. Thus, a differential-pressure control valve 100 is formed.

The differential-valve spring 100*c* is installed in a compressed condition to press the valve body 100*a* against the valve seal surface 2*j*. Since the pressing force determines a value of excess suction pressure, factors for determining the magnitude of the pressing force, i.e., the depth of the valve hole 2*f*, the depth of the cap inserting portion 2*k*, the diameter of the valve body 100*a*, and the spring constant, the free length and the spring diameter of the differential-pressure valve spring 100*c*, must be managed with proper accuracy.

Alternatively, the valve cap 100*f* may be fastened by the following technique. The outside diameter of the valve cap 100*f* is made to be smaller than the diameter of the valve cap inserting portion 2*k* and the valve cap 100*f* is inserted into the valve cap inserting portion 2*k* until the pressing force of the spring 100*c* reaches a normal value. Then, the valve cap 100*f* is expanded to be fastened to the valve cap inserting portion 2*k*. In this technique, the factors such as the size of the above-mentioned portions and the spring constant do not need to be managed precisely, so that the productivity can be improved. In both these techniques, the outer edge of the valve cap 100*f* and the inner edge of the valve cap inserting portion 2*k* must be sealed completely at the end of the assembly. To achieve the perfect seal, adhesion or welding may be used.

Returning to FIG. 1, a frame 4 has at an outer circumference a face 4*b* for mounting the fixed scroll member 2 and a face 4*d* provided inside the face 4*b*. Frame Oldham's grooves 4*e* and 4*f* (not shown) are also provided inside the face 4*d* for placing an Oldham's ring 5 between the frame 4 and the orbiting scroll member 3. A shaft seal 4*a* and a main bearing 4*m* are provided in the center, while a shaft thrust face 4*c* is provided on the scroll side for receiving the shaft. A lateral hole 4*n* is opened from the side of the frame toward a space between the shaft seal 4*a* and the main bearing 4*a*. Further, a plurality of communicating grooves 4*h* are provided around the circumferential surface for use as passages for gas and oil.

In the Oldham's ring 5, frame projections 5*a* and 5*b* (not shown) are provided on one face while projections 5*c* and 5*d* are provided on the other face.

With the inside of a shaft 12, a shaft oiling hole 12*a*, a main bearing oiling hole 12*b*, a shaft seal oiling hole 12*c* and a sub-bearing oiling hole 12*i* are provided. A balance holder 12*h* with its diameter being larger than the shaft 12 is located at the upper portion of the shaft 12, and a shaft balance 49 is press fitted into the balance holder 12*h* with an eccentric portion 12*f* provided therein.

With a rotor 15, a non-magnetized permanent magnet (not shown) is built in laminated steel plates 15*a*, and rotor balances 15*c* and 15*p* are provided at both ends.

With a stator 16, a plurality of stator grooves 16*c* are provided around the circumference of laminated steel plates 16*b* for use as passages for compressible gas and oil. The stator grooves 16*c* may be replaced by lateral holes opened into the inside of the laminated steel plates 16*b*.

The above elements are assembled as follows. The shaft 12 into which the shaft balance 49 has been press fitted is inserted in the main bearing 4*a* of the frame 4, and the rotor 15 is put in place by a technique such as press fit or shrinkage fit. The Oldham's ring 5 is mounted in the frame 4 by inserting the frame projections 5*a*, 5*b* of the Oldham's ring 5 into the frame Oldham's grooves 4*f*, 4*e*, respectively. The orbiting scroll member 3 is then mounted on the face 4*d* while inserting the projections 5*c*, 5*d* of the Oldham's ring S into the Oldham's grooves 3*g*, 3*h*, and the eccentric portion 12*f* of the shaft 12 into the bearing 3*w*, respectively. The fixed scroll member 2 is meshed with the orbiting scroll member 3, and while rotating the shaft 12, the fixed scroll member 2 is fastened to the frame 4 with a cover screw 53 in a position in which the rotating torque is minimized. The thickness of the end plate 3*a* of the orbiting scroll member 3 is set to 10–20 μm smaller than a gap between the face 4*d* and a reference surface 2*u* to control the maximum axial-distance between the orbiting scroll member 3 and the fixed scroll member 2. An excess-suction-pressure region 99 is provided at the backside of the orbiting scroll member 3. On the other hand, a cylindrical casing 31 is formed such that the stator 16 is shrinkage-fitted thereinto and a bearing support plate 18 is fixed thereto with spot-welding, the bearing support plate 18 welded with a gas cover 88 having a gas vent passage 88*a*. The above assembly is then inserted into the cylindrical casing 31 and tack-welded to the side of the frame 4. The rotor 15 and the stator 16 thus form a motor 19 and define a motor chamber 62 between the bearing support plate 18 and the frame 4. A bearing housing 70 is so incorporated that one end of the shaft 12 projecting from a central hole of the bearing support plate 18 will be inserted into a cylindrical hole of a spherical bearing 72 mounted in the bearing housing 70. The bearing housing 70 is moved while detecting the rotating torque of the shaft 12 to find a position in which the rotating torque is minimized, and spot-welded at the position to the bearing support plate 18. An oiling cap 90 with a feed oil pipe 71 welded thereto is screwed in the bearing housing 70 through a seal 73. The feed oil pipe 71 is bent downwardly after the oiling cap 90 is screwed in the bearing housing 70. After that, a bottom casing 21 with a discharge pipe 55 welded at the upper portion is welded to the cylindrical casing 31 to form an oil storage chamber 80. A magnet 89 is provided near the tip of the feed oil pipe 71. An upper casing with a hermetic terminal 22 welded at the upper portion is also welded to the cylindrical casing 31 so that the internal terminal pin of the hermetic terminal 22 can be connected to the electrical chords 77, thus forming a fixed backside chamber 61.

Next, operation of the first embodiment will be described. The shaft 12 is rotated by the rotation of the motor 19 to turn the orbiting scroll member 3. Since the Oldham's ring 5 prevents the orbiting scroll member 3 from rotating about its axis, compressible gas in a suction chamber 60 flows into the compression chambers 6 formed between both scroll members, and is compressed therein and discharged from the discharge hole 2*d* to the fixed backside chamber 61. The compressible gas discharged to the backside chamber 61 passes through the communicating grooves 2*r* and 4*h*, respectively located around the circumferences of the fixed scroll member 2 and the frame 4, and flows into the motor chamber 62. The compressible gas in the motor chamber 62 cools the motor 19 while passing through the stator grooves 16*c*. In this process, the compressible gas flow runs up against each part of the motor 19 to isolate oil contained in the gas. The isolated oil drops to the lower portion of the motor chamber 62. The compressible gas in the motor chamber 62 flows out from the discharge pipe 55 to the outside. Since the compressible gas in the motor chamber 62 passes through a narrow vent 18*b* and flows in the upper portion of the oil storage chamber 80, pressure in the oil storage chamber 80 is lower than that in the motor chamber 62 under the influence of the passage resistance. Lubricating oil 56 in the motor chamber 82 thus flows in the oil storage chamber through an oil supply hole 18*a*. Although the gas flows in the oil storage chamber 80 together with the lubricating oil 56 to cause a rise of gas bubbles to the surface of the lubricating oil 56 in the oil storage chamber 80, the bubbles rise in the gas vent passage 88*a* and are prevented from getting into the feed oil pipe 71, thereby improving the reliability of the bearings.

As discussed above, the lubricating oil 56 can be stored inside a compact compressor while maintaining the rotor 15 and the shaft 12 above the oil level. The embodiment shows a special advantage of making a horizontal compressor compact and reliable.

The thickness of the end plate 3*a* of the orbiting scroll member 3 is set to 10–20 μm smaller than a gap between the face 4*d* and the reference surface 2*u* to control the maximum axial-distance between the orbiting scroll member 3 and the fixed scroll member 2. When the motor starts, if the rotational speed of the orbiting scroll member 3 is set to the highest value in all the acceptable values in that case, e.g., 6000 rev/min, the suction pressure can be reduced sufficiently up to the maximum in the operating range required, and besides, the discharge pressure can rise over the excess suction pressure by a value of the excess suction pressure or more. As a result, the pressure in the motor chamber 62 becomes higher than the suction pressure over the excess suction pressure value, and the oil and the compressible gas contained in the oil act under pressure as follows. The oil and the compressible gas contained in the oil pass through the shaft oiling hole 12*a*, flow in the backside excess-suction-pressure region 99 provided at the backside of the turning scroll member 3 through a space between the bearing 3*w* and the eccentric portion 12*f* and a space between the main bearing 4*a* and the shaft 12, and press the orbiting scroll member 3 against the fixed scroll member 2. The gap between the top and bottom of the scroll wraps thus becomes normal so that the compression can be performed normally. Since the compressor can be activated by itself without any external assistant, the operability of the compressor can be improved.

The space between the bearing 3*w* and the eccentric portion 12*f* and the space between the main bearing 4*a* and the shaft 12 are bearing clearances. Each bearing clearance is very narrow and it is a reduction passage for the oil with the compressible gas contained therein flowing into the excess-suction-pressure region 99. For this reason, the pressure in the backside excess-suction-pressure region 99 becomes lower than the discharge pressure without fail, i.e., it must be lower than the sum of the suction pressure and the excess suction pressure value under the influence of pressure losses. When the motor starts, the backside of the turning scroll member 3 is pressed to the face 4*d* by pull-off force and the excess-suction-pressure region 99 becomes an enclosed space, so that the pressure in the backside excess suction-pressure region 99 rises up to the sum of the suction pressure and the excess suction pressure value securely. It is therefore possible to activate the compressor by itself with the action of the face 4*d* even if pressure losses are caused by the bearings.

In the embodiment, the discharge pressure denotes pressure in the fixed backside chamber 61 not in the discharge hole 2*d*. The pressure is determined by the pressure in the discharge hole 2*d* and the cycle pressure.

When the compressor starts by limiting the maximum separate distance and shifts to normal operation, the oil and compressible gas from the main bearing 4*a* and the bearing 3*w* continue to flow in the backside excess-suction-pressure region 99. Since the orbiting scroll member 3 is pressed to the fixed scroll member 2, the compressible gas and the oil pass between the turning backside and the face 4*d* and flow into the surrounding groove 2*c* to which the pressure-difference control valve 100 is open. When the pressure becomes higher than the suction pressure by a value of the excess suction pressure, the compressible gas and the oil moves the valve body 100*a* against the pressing force of the differential-pressure valve spring 100*c*, and flows in the valve hole 2*f* through a space between the valve seal surface 2P and the valve body 100*a*, the space formed by the movement of the valve body 100*a*. The compressible gas and the oil then pass through the suction passage 2*i* and the suction groove 2*j* and are discharged to the suction chamber 60. Since such a flow takes a shortcut from the discharge system to the suction system in the compressor and it corresponds to the internal leakage at scroll wraps, it is necessary to reduce the flow as much as possible. However, as the backside discharge passage for introducing pressure into the excess-suction-pressure region 99 is the bearing clearance, it becomes a reduction passage, so that the flow rate becomes low enough to prevent lowering of the compressor performance.

The four bypass holes 2*e* are provided on the end plate 2*a* of the fixed scroll member 2, which are always open to all compression chambers, as shown in FIG. 13, the compression chambers defined in the compression process. The bypass valve is formed by fastening the bypass valve plate 23 with the bypass screw 50 while covering the bypass holes 2*e* with the bypass valve plate 23. The bypass valve is opened when the pressure in the compression chambers 6 becomes higher than that of the fixed backside chamber 61 in the discharge system. Since the pressure in the backside chamber 61 is discharge pressure, when the pressure in the compression chambers 6 is higher than the discharge pressure, the bypass valve communicates the compression chambers 6 with the discharge system to form a control bypass.

The use of the pressure-difference control valve and the control bypass valve in combination in the scroll compressor has the advantages as described below. When the operating range required is in an excessive-compression operating state in which the design pressure ratio corresponding to the design capacity ratio is larger than the actual pressure ratio (i.e., when the pressure in the compression chambers is higher than that in the compressor), the control bypass valve acts on the pressure in the compression chambers not to increase the pressure in the compression chambers larger than the discharge pressure when the suction pressure is high, so that the pull-off force to separate the orbiting scroll member and the fixed scroll member becomes smaller than the pull-off force due to the excessive compression. When compared with the operation under the rated conditions, the increment of the attractive force required for attracting both scrolls against the pull-off force is lower than the increasing ratio of the suction pressure. For this reason, the excess suction pressure value can be set smaller than that in the compressor with no control bypass (the maximum pull-off force in the compressor operating range can be reduced), and thereby the attractive force can be made small throughout the operating range. Since the excess suction pressure value can be made small even when the pull-off force is small, any excess attractive force can not be produced.

The deformation of the scroll members is thus prevented, and seals of the compression chambers becomes easy to manage, so that the internal leakage can be inhibited to improve the overall adiabatic efficiency. In the case the turning scroll member and the support member relatively move, the energizing force acting to the slide portion is reduced, so that the danger of sliding friction loss and wear can be reduced, thereby improving the overall adiabatic efficiency and the reliability. Particularly, when the compressor is operated under the rated conditions requiring a high level of the overall adiabatic efficiency and the reliability, the energizing force is largely reduced to achieve further improvement of the overall adiabatic efficiency and the reliability.

Such a control bypass is shown in Japanese Patent Laid-Open Application (JP-A) No. 58-128485 (document 2). The document 2 teaches a compressor in which the compression chamber is prevented from increasing pressure over the discharge pressure to reduce the curve of the pressure graph and hence thermal fluid losses under excessive-compression conditions for the purpose of improving the overall adiabatic efficiency. The compressor described in the document 2 shows the same advantages as that in the above embodiment, but the following is not mentioned therein, i.e., the subject matter of reduction in friction loss and the like. In the embodiment, the maximum pressure in the compression chambers is averaged near the discharge pressure to reduce the excess suction pressure value to be added to the suction pressure, so that occurrence of the excess attractive force under low pressure in the compression chambers is prevented, thereby reducing friction losses and the like. In other words, the document 2 never mentions the advantages of using the pressure-difference control valve and the control bypass valve together in the compressor.

In a typical refrigerating cycle, the conditions of operating pressure are so changed that the suction pressure is reduced and simultaneously the discharge pressure is risen for the purpose of increasing the operation ability. For example, the rotating speed of the compressor is increased when a movable valve that throttles or is able to throttle a throttle valve in the refrigerating cycle is absent. Reverse, the operation ability can be reduced by increasing the suction pressure simultaneously with a reduction of the discharge pressure.

Figure 2:
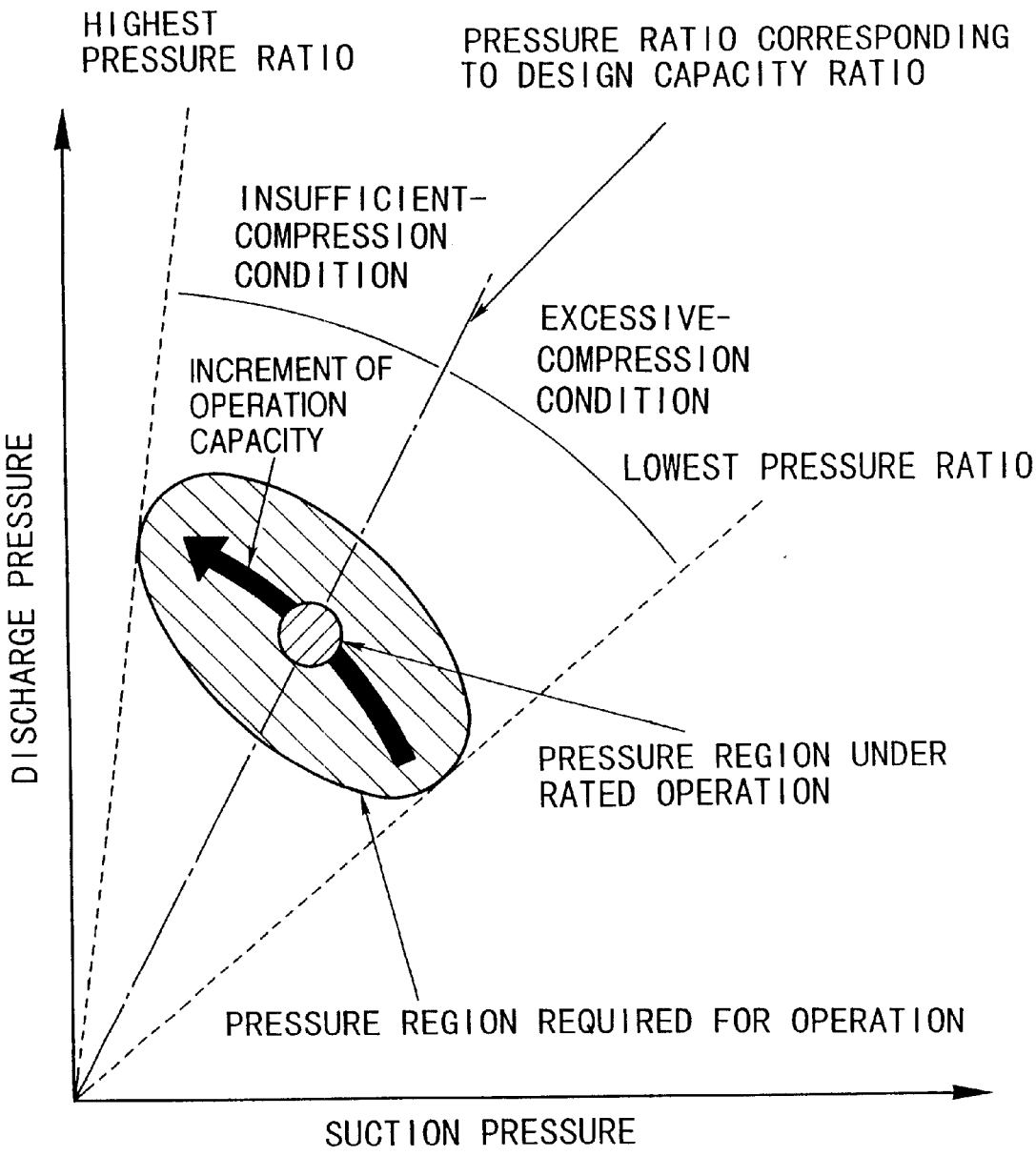
FIG. 2 is a chart showing a pressure region required when the compressor is used for a refrigerating cycle.

The pressure operating range required by the compressor in a refrigerating cycle has the tendency as shown in FIG. 2, i.e., it is indicated by a region extending off the lower right (an elliptical region with hatching) on the graph of which abscissa shows suction pressure and ordinate shows discharge pressure. As apparent from the graph, excessive-compression conditions become heavy as the suction pressure increases (since the compression ratio of the compressor is determined in design, an increase in suction pressure causes a reduction of the discharge pressure in the compressor because of characteristics of the refrigerating cycle, so that the pressure in the compression chambers can exceed the discharge pressure). The higher the suction pressure, the more the control bypass reduces the pressure on the side of the compression chambers. When compared with the operation under the rated conditions, the attractive force required becomes very much lower than the increasing ratio of the suction pressure.

When the suction pressure is high, the discharge pressure is reduced under the influence of refrigerating cycle. Since the discharge pressure required for the refrigerating cycle is low, the pressure difference between the discharge pressure and the suction pressure becomes lower than that in the operation by the compressor alone (where the discharge pressure is proportional to the suction pressure). The control bypass valve is opened at this time, so that the internal pressure of the compression chambers becomes this low discharge pressure to reduce the pull-off force. The attractive force can thus be set to such a small value as it prevails against the pull-off force. When the suction pressure is low, the discharge pressure required for the refrigerating cycle increases. Since the pressure runs low in this case, the bypass valve is not opened.

The excess suction pressure value can thus be set to be much lower, so that the attractive force becomes very small throughout the operating range to effectively prevent the deformation of the scroll members, thereby largely improving the overall adiabatic efficiency. In the case the orbiting scroll member and the support member relatively move, the energizing force acting to the slide portion is largely reduced, so that the danger of sliding friction loss and wear can be reduced, thereby further improving the overall adiabatic efficiency and the reliability. Particularly, when the compressor is operated under the rated conditions requiring a high level of the overall adiabatic efficiency and the reliability, the energizing force is largely reduced to achieve further more improvement of the overall adiabatic efficiency and the reliability.

As discussed above, since the excess suction pressure region 99 is provided at the backside of the orbiting scroll member for use as attractive force applying means of the orbiting scroll member 3 in addition to the control bypass, the excess suction pressure value can be set small and the energizing force can be set small in a wide operating range. As a result, the overall adiabatic efficiency and the reliability can be made high in a wide operating range.

Since the four bypass holes 2*e* are provided for communicating the compression chambers 6 with the fixed backside chamber 61 constantly, even when fluid compression is likely to occur, the bypass valve can be opened to discharge fluid to the fixed backside chamber 61 before the pressure extremely rises. It is therefore possible to avoid the danger of damaging the wraps and hence to improve the reliability. The excessive compression can also be inhibited to make the overall adiabatic efficiency high even under the operating conditions accompanying a low pressure ratio.

The oil of the discharge pressure from the shaft oiling hole 12*a* flows into the bottom of the bearing holder 3*s* located at the backside center of the end plate 3*a* of the orbiting scroll member 3, and the space on the bottom of the bearing holder 3*s* is defined as a discharge pressure region 95 (the discharge pressure region 95 is a region corresponding to the inside diameter of the bearing 3*w*). The project area viewed from the axis is set between the maximum and the minimum of the sum of the project area viewed from the axial direction of the discharge chamber and half the top areas of both scroll wraps that form a boundary between the compression chambers surrounding the discharge chamber. It is therefore unnecessary to take into account contribution of the discharge pressure to the pull-off force.

With the area of the backside discharge pressure region corresponding to the attractive force applying means, the operation of applying a force having substantially the same magnitude as a force contained in the pull-off force that is contributed from the fluid in the discharge chamber will be described below. The region of the end plate on the side of the compression chambers to which the discharge pressure acts is determined by the project area viewed from the axial direction of the discharge chamber and half the top areas of both scroll wraps that form a boundary of the discharge chamber. Since the latter is a seal portion between the discharge chamber and one compression chamber located outside of the discharge chamber, one portion close to the discharge chamber becomes the discharge pressure and the other portion close to the outside compression chamber becomes the pressure in the compression chamber. It is therefore considered that the mean pressure of the discharge pressure and the pressure in the compression chamber is applied to the latter area. In this respect, the area in which the discharge pressure is applied is half the top areas. Since these areas are changed as the orbiting scroll member revolves, the time average of the areas should be taken for definition of the area of the backside discharge pressure region, but such definition is difficult. For proper approximation and clear definition, the area is set between the maximum and the minimum of changeable values. As a result, contribution of the discharge pressure to the pull-off force does not need to be taken into account, so that the set value of the excess suction pressure can be further reduced, thereby improving the overall adiabatic efficiency and the reliability much more greatly.

The description was made to the advantages of the embodiment in which the overall adiabatic efficiency and the reliability can be further improved since the excess suction pressure value of the pressure in the backside excess-suction-pressure region can be set smaller. An example of the project area is shown in FIG. 9. In the drawing, there is shown a project area at the instant of communicating the innermost compression chambers A1, A2 with the discharge chamber A3. Assuming that the project area is formed immediately after establishing the communication, the project area has the maximum:

$$A1+A2+A3+K2+K3+S2+S3+(K1+S1)/2$$

Assuming that the project area is formed immediately before establishing the communication, the project area has the minimum:

$$A3+(K3+S3)/2$$

When the compressor is used for a refrigerating cycle, the operating range of the suction pressure and the discharge pressure is such that the discharge pressure is reduced under high suction pressure conditions as shown in FIG. 9. In this case, the use of the control bypass causes suppression or inhibition of excessive compression, so that the pull-off force becomes small even when the suction pressure increases. It is therefore possible to set the excess suction pressure value much smaller, and hence to further improve the overall adiabatic efficiency and the reliability. The refrigerating cycle is one of applications requiring the operating range shown in FIG. 9, but the advantages of the embodiment are not limited by the refrigerating cycle. The same advantages can be obtained in other applications requiring an operating range under the same pressure conditions.

With the embodiment, FIGS. 3 through 5 show results of calculation of energizing force acting to the orbiting scroll member at each shaft rotating angle of the compressor using such a orbiting scroll member 3 as shown in FIG. 12. In these graphs, the inside diameter of the bearing for the orbiting scroll is 16 mm and the excess suction pressure value is 2.3 kgf/cm$^2$, and therefore in these graphs, the solid line shown by Pb=Ps+2.3 is the energizing force. For the purpose of comparison the case the bypass valve is absent and the case intermediate pressure holes are provided in positions as shown in FIG. 12 to apply intermediate pressure to the backside of the orbiting scroll are shown. In the method of applying intermediate pressure to the backside of the orbiting scroll by providing the intermediate holes, the pressure at the backside of the orbiting scroll is a constant multiple of the suction pressure. In these charts, the pressure is calculated by using a constant of 1.5, and therefore the other graph, which indicates the case the intermediate holes are used, is shown as Pb=Ps*1.5. The broken line represents one component of the energizing force on the assumption that the inclination moment is received by components of the energizing force resulted at the inner edge of the reference surface 2*u* of the fixed scroll member. Since the positive direction of the force is set to the direction in which the wraps of the orbiting scroll stands, the energizing force exhibits negative values. In these charts, Ps is suction pressure, Pd is discharge pressure, Pb is backside pressure of the orbiting scroll and N is rotating speed of the orbiting scroll. Three conditions in the charts are operating conditions when the compressor is used in an air conditioner under excessive compression: one corresponds to a rated cooling condition, another corresponds to an intermediate cooling condition and the other corresponds to a minimum cooling condition in cooling operation. It should be noted that the danger of inclining the orbiting scroll member due to the inclination moment becomes large when the component force exceeds the energizing force in magnitude. In the case the bypass valve is absent, the orbiting scroll member is likely to incline at all the three conditions, and it is found that the excess suction pressure value of 2.3 is insufficient. Although the excess suction pressure value can be set larger, another problem arises that the energizing force increases in magnitude correspondingly to such larger value when the compression is insufficient.

This example concretely shows that the excess suction pressure value can be set small by using the backside excess-suction-pressure region and the bypass valve in combination. It is also found that the level of the energizing force is low enough and the overall adiabatic efficiency and the reliability are superior to the intermediate pressure hole system. It is impossible for the intermediate pressure hole system to set the constant a little bit small because the attractive force becomes insufficient under low suction pressure and high discharge pressure.

With the embodiment, FIGS. 6 though 8 show results of calculation of energizing force acting to the orbiting scroll member when the area of the backside discharge pressure region is changed. A 16 mmϕ backside discharge pressure region, i.e., the backside discharge pressure region having a diameter of 16 mm, meet the above conditions, while other two backside discharge pressure regions do not meet them. In the case the 16 mmϕ backside discharge pressure region among the three conditions, the orbiting scroll member is not inclined, and beside, the energizing force becomes small.

This example concretely shows that the excess suction pressure value can be set small without inclining the orbiting scroll member under various conditions when the bypass valve is used and the area of the backside discharge pressure region is set between the maximum and the minimum of the sun of the project area viewed from the axial direction of a discharge chamber defined by both end plates communicating with the discharge system at compression operating time at which the control bypass does not communicate the compression chambers with the discharge system, and half the top areas of both scroll wraps that form a boundary between the discharge chamber and the compression chambers surrounding the discharge chamber.

Many refrigerant gases including R32 are used under very high pressure. Even when such refrigerant gases are used, the compressor having both the backside excess-suction pressure region and the control bypass permits a reduction of the energizing force acting to the orbiting scroll member, so that the danger of wear can be avoided, thereby providing a reliable compressor.

Several other embodiments will be described below. The technical concepts of the first embodiment are also reflected on the following embodiments. Although in the first embodiment no discharge valve is provided in the discharge hole 2*d*, such a discharge valve can be provided as the means of recovery when the pressure is insufficient, i.e., when the pressure in the fixed backside chamber becomes high (it can be applied to the following embodiments).

Figure 17:
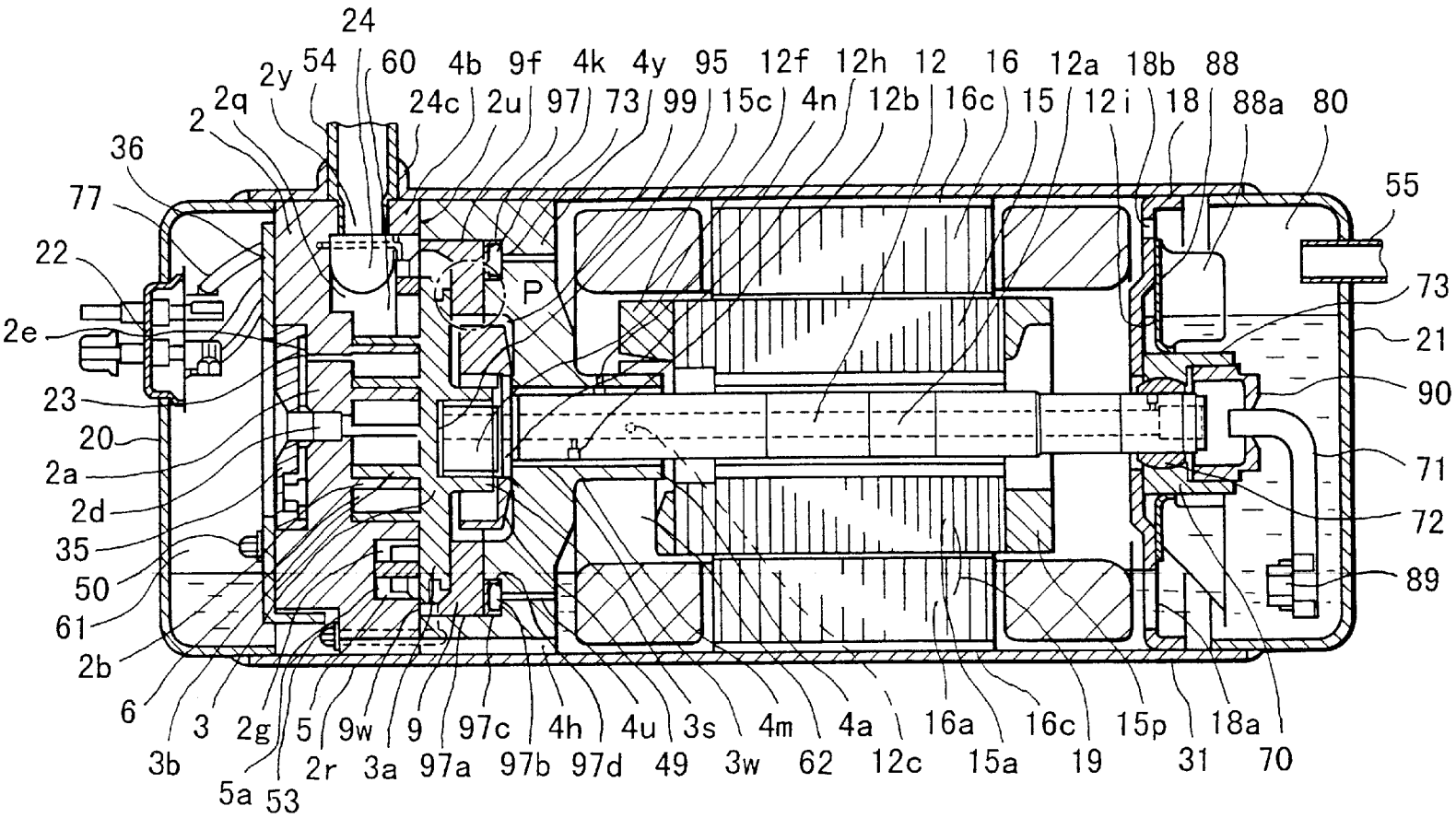
FIG. 17 is a longitudinal sectional view of a compressor according to a second embodiment.
Figure 18:
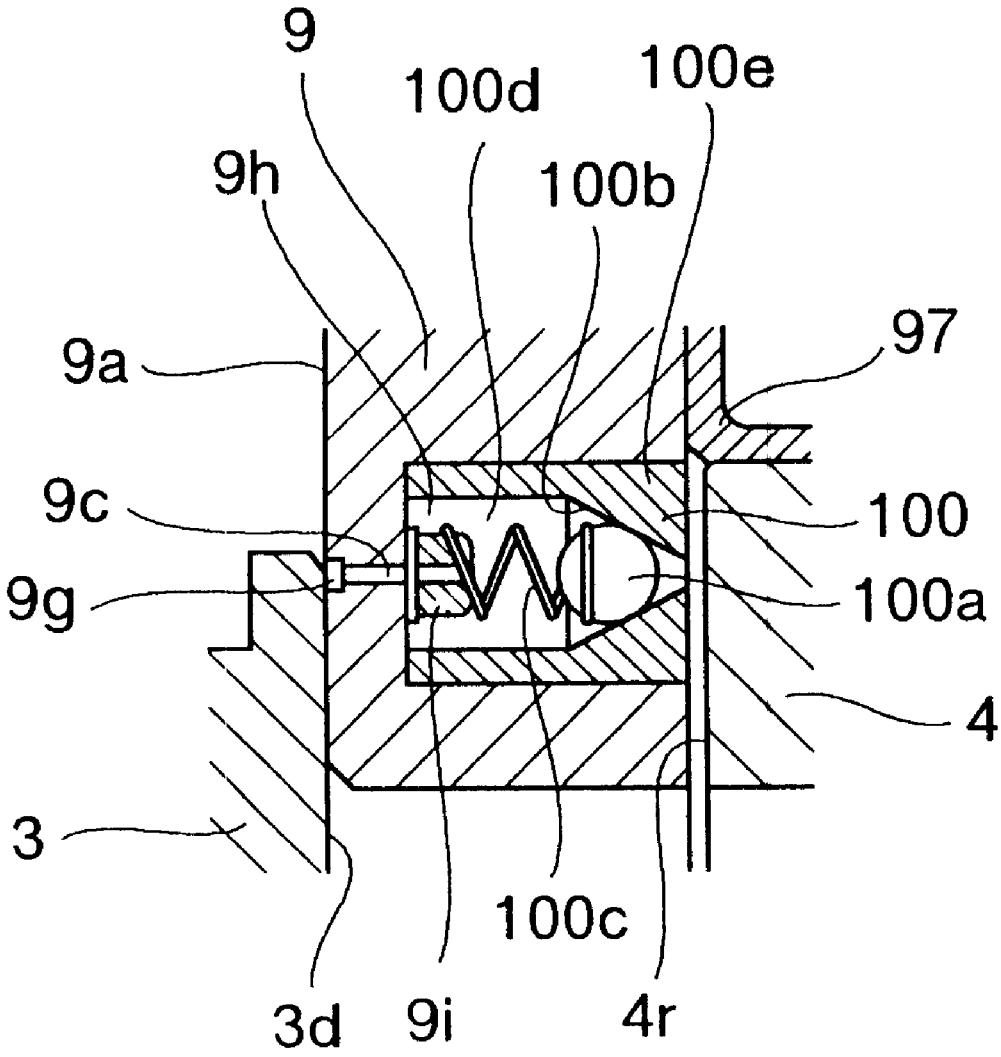
FIG. 18 is a longitudinal sectional view of a pressure-difference control valve (portion P in FIG. 17) of the second embodiment.

Referring to FIGS. 17 and 18, a second embodiment of the present invention will be described. The second embodiment embodies the present invention in a thrust release type horizontal scroll compressor. In the scroll compressor, a non-turning scroll member is fixed to a casing to form a fixed scroll member. A backside excess-suction-pressure region is provided at the backside of an end plate of a orbiting scroll member, the backside located on the opposite side of compression chambers. A thrust member is mainly used as a scroll support member of the orbiting scroll member, which is provided at the backside within operating pressure conditions required. In other words, the orbiting scroll member is pressed to the thrust member at the backside instead of the fixed scroll member and the thrust member can be moved in the axial direction.

FIG. 17 is a longitudinal sectional view of the compressor and FIG. 18 is a longitudinal sectional view of a pressure-difference control valve.

The construction will first be described. The motor chamber 62 and the oil storage chamber 80 are the same as those in the first embodiment, and the description will be omitted.

An orbiting scroll member 3 is provided with Oldham's grooves 3*g*, 3*h* (not shown) on a surface of an end plate 3*a* on which a scroll wrap 3*b* stands, and a bearing holder 3*s* with a bearing 3*w* inserted therein at the backside. A thrust face 3*d* is also provided in the outer circumference portion of the backside surface. The scroll wrap 3*b* is reduced in thickness gradually from the center to the outer edge except the center end and the outer end.

A fixed scroll member 2 has a reference surface 2*u* placed in the same plane as the top of the scroll wrap, and four bypass holes 2*e* provided on the bottom. The reason of why four bypass holes 2*e* are provided is that the bypass holes are always opened to all compression chambers 6. A bypass valve plate 23 which is a lead valve plate is then fastened with a bypass screw 50 so as to cover the bypass holes 2*e*. A discharge hole 2*d* is also opened near the center of the fixed scroll member 2.

Oldham's grooves 2*g* and 2*h* (not shown) are provided for placing an Oldham's ring 5 between the orbiting scroll member 3 and the fixed scroll member 2. A suction dig 2*q* is provided on the outer side of the bottom surface of the wrap, and a suction hole 2*v* is provided in the dig 2*q* for inserting a suction pipe 54 from the side. A plurality of communicating grooves 2*r* are also provided around the circumference of the fixed scroll member 2 for use as passages for discharge gas and oil. The bypass valve plate 23 is fastened with the bypass screw 50 to the bypass holes 2*e* and a center cover 35 serving as a retainer is mounted thereon. The center cover 35 has holes to form passages for the gas coming out of the bypass holes 2*e*. The center cover 35 also acts to insulate noise when the bypass valve is opened or closed. A heat-insulating cover 36 is then fastened with a screw onto the center cover 35. The fixed scroll wrap 2*b* is reduced in thickness gradually from the center to the outer edge in the same manner as the orbiting scroll wrap 3*b*.

A suction check valve 24 is composed of a valve plate 24*a* and a valve shaft 24*c*. The end portion of the valve plate 24*a* is formed into a bearing portion with a round shape, and the valve shaft 24*c* is inserted in the bearing portion. One end of the valve shaft 24*c* is press fitted into or bonded to a hole provided in the suction dig 2*q* of the fixed scroll member 2.

The thrust member 9 is such that a stopper 9*f* projects at the outer edge of a surface on the side of a slide thrust bearing 9*a* to form a surface 9*w* opposite to a reference surface of the orbiting scroll member. Since the thrust bearing 9*a* and the surface 9*w* opposite to the reference surface are provided in parallel in the same direction, the embodiment shows a special advantage of easily machining the parts on a lathe or by a grinder while managing the distance between the two surfaces precisely.

Although the distance between the thrust bearing 9*a* and the surface 9*w* opposite to the reference surface is one of factors for determining a gap between the top and the bottom of the scroll wraps, since it is easy to relive the dimensional accuracy, the embodiment shows a special advantage of mass-producing a scroll fluid machine with less deviation of the performance and the reliability. A circular oil groove 9*g* is provided on the slide thrust bearing 9*a* and a suction passage 9*c* is provided in the oil groove 9*g* so as to be open to a differential-pressure valve inserting hole 9*h* dug out from the backside of the thrust member. Since the thrust member 9 can be rotated about the axis, any rotation preventing means is not required, so that the construction of the compressor is simplified to improve the workability.

A differential-pressure control valve 100 is incorporated in the differential-pressure valve inserting hole 9*h*. A differential-pressure spring 100*c* is press-fitted onto a spring positioning projection 9*i* located at the bottom of the differential-pressure valve inserting hole 9*h*, and a globular valve body 100*a* is mounted in a cylindrical case 100*e* provided with a valve hole 100*d* having a tapered valve seal surface 100*b* and penetrated through the case. In such an arrangement, the differential-pressure control valve 100 is press-fitted into, bonded or welded to the differential-pressure valve inserting hole 9*h*.

The differential-valve spring 100*c* is thus compressed to press the valve body 100*a* against the valve seal surface 100*b*. Since the pressing force determines a value of excess suction pressure, factors for determining the magnitude of the pressing force, i.e., the depth of the valve hole 100*d*, the diameter of the valve body 100*a*, and the spring constant, the natural length and the spring diameter of the differential-pressure valve spring 100*c*, must be managed with proper accuracy.

Alternatively, the differential-pressure control valve 100 may be formed by setting the inside diameter of the differential-pressure valve inserting hole 9*h* larger than the outer diameter of the valve case 100*e* and bonding the valve case 100*e* in a position in which the pressing force becomes a normal value. In this technique, the factors such as the size of each portion and the spring constant do not need to be managed precisely, so that the productivity can be improved. In both cases, a portion between the differential-pressure valve inserting hole 9*h* and the valve case 100*e* are sealed completely at the end of the assembly.

A thrust seal 97, formed of a heat resistant engineering plastic or a phosphor bronze plate or a stainless steel plate serving as a spring material, is composed of a lifting surface 97*a* for lifting the thrust member 9, a backside groove 97*b*, an outer seal portion 97*c* and an inner seal portion 97*d*.

A frame 4 has a clamp face 4*b* for mounting the fixed scroll member 2 around the outer edge, and a thrust groove 4*k* provided inside the clamp face 4*b*. A plurality of communicating grooves 4*h* are provided around the outer surface for use as passages for gas and oil. A shaft seal 4*a* and a main bearing 4*a* are provided in the center with a shaft thrust face formed on the top end surface of the main bearing for receiving the shaft. A lateral hole 4*n* is opened from the side of the frame toward a space between the shaft seal 4*a* and the main bearing 4*a*. Further, pressure passages 4*u* and 4*v* are provided on the bottom of the thrust groove 4*k* so as to be open to the backside of the frame. The thrust seal 97 is inserted into the thrust groove 4*k* to form a seal backside space 73 at the backside of the thrust seal 97.

In the Oldham's ring 5, projections 5*a* and 5*b* (not shown) are provided on one face while projections 5*c* and 5*d* are provided on the other face.

With the inside of a shaft 12, a shaft oiling hole 12*a*, a main bearing oiling hole 12*b*, a shaft seal oiling hole 12*c* and a sub-bearing oiling hole 12*i* are provided. A balance holder 12*h* with its diameter being larger than the shaft 12 is located at the upper portion of the shaft 12, and a shaft balance 49 is press-fitted onto the balance holder 12*h* and an eccentric portion 12*f* is provided therein.

The above elements are assembled as follows. The shaft 12 into which the shaft balance 49 has been press-fitted is first inserted in the thrust bearing 4*a* of the frame 4, the thrust bearing 4*a* having the thrust seal 97 inserted in the thrust groove 4*k*. Then, the rotor 15 is put in place by a technique such as press fit or shrinkage fit. The thrust member 9 is put on the lifting surface 97*a* of the thrust seal 97 and mounted in the frame 4. The fixed scroll member 3 and the Oldham's ring 5 are assembled by inserting the projections 5*a*, 5*b* of the Oldham's ring 5 into the Oldham's grooves 2*g*, 2*h* of the fixed scroll member 2, respectively. The Oldham's ring 5 and the orbiting scroll member 3 are assembled by inserting the projections 5*c*, 5*d* of the Oldham's ring 5 into the Oldham's grooves 3*g*, 3*h*. The orbiting scroll member 3 is mounted on the thrust member 9 while inserting the eccentric portion 12 *f* of the shaft 12 into the bearing 3*w*. The shaft 12 is then rotated and the fixed scroll member 2 is fastened with a cover screw 53 to the frame 4 in a position in which the rotating torque is minimized. At this time, the thrust member 0 is pressed against the fixed scroll member 2 and the reference surface 2*u* and the surface 9*w* opposite to the reference surface are are forcibly brought into contact with each other. Under this condition, by setting an axial distance between frame thrust surface 4*r* and the thrust backside 9*r* of the thrust member 9 so as to be 10–20 $\mu$m, the maximum axial-distance between the orbiting scroll member 3 and the fixed scroll member 2. An excess-suction-pressure region 99 is thus defined at the backside of the orbiting scroll member 3. Since other assemblies such as the motor chamber 62, the oil storage chamber 80 and the backside chamber 61 are assembled in the same manner as in the first embodiment, the description will be omitted.

Next, operation of the second embodiment will be described. Since the flow of compressible gas and oil fed from the discharge chamber to the backside chamber 61 is the same as that in the first embodiment, only the operation in the scroll member and the frame will be described and the other description will be omitted.

The thrust member 9 arranged at the backside of the orbiting scroll member 3 is pressed to the fixed scroll member 2 by the thrust seal 97 located at the backside, and the surface 9*w* opposite to the reference surface and the reference surface 2*u* are forcibly brought into contact with each other to position the slide thrust bearing 9*a*. The thrust face 3*d* of the orbiting scroll member 3 rides thereon and therefore a position of the orbiting scroll in the axial direction is determined. Since a gap between the top and the bottom of the scroll wraps is determined at this position, the slide thrust bearing 9*a* is so positioned that the gap will be formed properly. The thrust seal 97 pushes the thrust plate 4 toward the fixed scroll member 2 due to compressible gas and oil enclosed in the seal backside space 73 under discharge pressure behind the thrust seal 97. The compressible gas and the oil enclosed in the seal backside space 73 under the discharge pressure passes through the pressure passages 4*u*, 4*v* and flows in from the motor chamber 62. The thrust seal 97 is made of a low-rigidity material such as engineering plastic or a spring material, and therefore the space between the outer seal portion 97*c* or the inner seal portion 97*d* and the side of the seal groove 4*k* and the space between the lifting surface 97*a* and the backside of the thrust member 9 are sealed completely to prevent a leakage of the seal portions from the discharge system to the suction system. It is therefore possible to improve the overall adiabatic efficiency. One pressure passage 4*u* is provided in the lower portion and is opened to the oil while the other pressure passage 4*v* is provided in the upper portion and is opened to the compressed gas. The oil flows in the seal backside space 73 through the pressure passage 4*u*, and the surface tension of the oil permits the oil to flow in the gap between the seal backside space 73 and the seal groove 4*k*, so that the sealing characteristics can be improved. Even when the thrust member 9 is separated from the fixed scroll member 2 due to an unexpected impacting force and the oil or the compressed gas enclosed in the seal backside space 73 is pushed out to the outside due to an unexpected impact force, since the compressed content is gas, it can flow from the pressure passage 4*v* to the seal backside space 73 for an instant. As a result, the thrust member 9 comes into contact with the fixed scroll member 2 again in a short time to avoid increasing the gap between the top and the bottom of the scroll wraps in the short time, so that a high-performance compressor can be provided.

The orbiting scroll member 3 orbits on the thrust member 9 as the shaft 12 is rotated, and the Oldham's ring 5 prevents the orbiting scroll member 3 from rotating about its axis. Such orbiting motion forms the compression chambers 6 between both scrolls to perform compression. Pressure higher than the suction pressure by a constant value is introduced into the backside excess-suction-pressure region 99, located at the backside, against the pull-off force acting to the orbiting scroll member 3 and the discharge pressure is introduced into the backside discharge pressure region 95 to generates an attractive force. The attractive force is set smaller than the pull-off force over the almost full operating range. For this reason, the thrust member 9 located at the backside is used as the support member of the orbiting scroll member 3. The discharge pressure in the backside discharge pressure region 95 is introduced by the oil supplied to the bearing 3*w* through the shaft oiling hole 12*a*. On the other hand, the bypass valves 23 serving as a control bypass are provided on the end plate 2*a* of the fixed scroll member 2. Since the excess suction pressure region 99 and the discharge pressure region 95 are provided at the backside of the orbiting scroll member as attractive force generating means for the orbiting scroll member 3 in addition to the control bypass, the excess suction pressure value can be set small and the energizing force can be set small in a wide operating range. As a result, the overall adiabatic efficiency and the reliability can be made high in a wide operating range.

A control method for controlling pressure in the backside excess-suction-pressure region 99 will be described below. Oil and compressible gas dissolved in the oil flow in the backside excess-suction-pressure region 99 through the bearing clearances of the main bearing 4*a* and the bearing 3*w*. The compressible gas and the oil flow through a gap, which is formed by the thrust member 9 being urged against the fixed scroll member 2, between the backside of the thrust member and the thrust face 4*r* of the frame to the opening portion of the pressure-difference control valve 100. Since the suction pressure is applied on the other face of the valve body 100*a* located at the opening, the valve body 100*a* is moved when the pressure of the compressible gas and the oil rises over the suction pressure by a pressure difference corresponding to the pressing force of the differential-pressure valve spring 100*c* to press the valve body 100*a*. The compressible gas and the oil are thus discharged to the suction chamber 60. Since the pressing force of the differential-pressure valve spring 100*c* cannot be changed very much by the ambient atmosphere, the pressure difference between the backside excess-suction-pressure region 99 and the suction chamber 60 is maintained at approximately a constant value. It is desirable to make the area of the backside excess-suction-pressure region 99 a bit wider upon operation with high discharge pressure. However, if it is not permitted to do so from the design of the bearing 3*w*, the differential-pressure valve spring 100*c* may be made of a material having a thermal expansion coefficient higher than that of the thrust member 9 and the valve case 100*e*. Generally, under the operating condition in which the temperature of the compressor becomes high, the discharge pressure also becomes high. In such operating condition, the differential-pressure valve spring 100*c* tends to extend accompanying the temperature rise, but the total length of the spring is restricted by the valve case 100*e*. Consequently, the pressing force increases. For this reason, the excess suction pressure value can be made large only when the compressor is operated under high discharge pressure. In other words, while restricting the excess suction pressure at small values, it is possible to increase the attractive force of the orbiting scroll member 3 only when the high discharge pressure. It is therefore possible to make the attractive force small under almost all the conditions, and hence to improve the overall adiabatic efficiency and the reliability at almost all the operating conditions.

Since the flow of compressible gas into the suction chamber 60 through the pressure-difference control valve 100 is a shortcut flow from the discharge system to the suction system in the compressor and it corresponds to the internal leakage in the scroll wraps, it is necessary to reduce the flow as much as possible. However, the backside discharge passage for introducing pressure into the excess-suction-pressure region 99 is the bearing clearance, as is similar to the first embodiment, so that the flow rate becomes low enough to prevent lowering of the compressor performance. On the other hand, the oil discharged from the pressure-difference control valve 100 flows in the oil groove 9*g* and acts to lubricate between the thrust bearing 9*a* and the thrust face 3*d*.

Since the axially movable distance of the thrust member 9 is set to 10–20 $\mu$m, the maximum axial-distance between the orbiting scroll member 3 and the fixed scroll member 2 is controlled at the same distance. When the motor starts, if the maximum separate distance has such a set value, the suction pressure can be reduced sufficiently up to the maximum in the required operating range if the rotational speed of the orbiting scroll member 3 is made to be an allowable maximum value of the orbiting scroll member, e.g., 6000 rev/min. Further, it is possible to rise the discharge pressure over the excess suction pressure by a value of the excess suction pressure or more. As a result, the compressible gas and the oil the pressure of which is higher than the suction pressure over the excess suction pressure value flow in the seal backside space 73 from the motor chamber 62 through the pressure passages 4*u* and 4*v*. Therefore, the outer seal portion 97*c* and the inner seal portion 97*d* are expanded and are forcibly brought into contact with the side surface of the seal groove 4*k* to secure their seal performance. The thrust seal 97 applies a pressing force to the thrust plate 4 to push down the thrust plate 4 toward the fixed scroll member 2. The pressing force applied by the thrust seal 97 is exerted in a direction to push down the orbiting scroll member 3 toward the fixed scroll member 2. Further, the compressible gas and the oil the pressure of which is higher than the suction pressure over the excess suction pressure value flow in the backside excess-suction-pressure region 99 and the backside discharge pressure region 95 in the same manner as in the first embodiment to form the means for attracting the orbiting scroll member 3 to the fixed scroll member 2. Since the former pressing force to the thrust seal 97 is not exerted at the top and the bottom of the scroll wraps at a normal operating condition at which the surface 9*w* opposite to the reference surface is forcibly brought into contact with the reference surface 2*u*, it will be set much larger than a required magnitude to secure the contact. As a result, the thrust member 9 is moved until the surface 9*w* opposite to the reference surface comes into contact with the reference surface 2*u*, so that the orbiting scroll member 3 can come close to the fixed scroll member 2 up to a normal position. It is therefore possible to activate the compressor by itself and hence to improve the workability.

Since the orbiting scroll member 3 is moved together with the thrust member 9, the top and bottom of the scroll wraps will never come into contact with each other even when they are likely to come into contact with each other due to deformation of the scroll wraps in the work time. The embodiment also shows a special advantage of making the compressor reliable.

In the case where the pressure ratio is extremely small and the energizing force applied by the orbiting scroll member 3 to the thrust member 9 becomes large to be as large as the force to push down the thrust member 9, the thrust member 9 cannot stand still to incline the orbiting scroll member 3 or move away from the fixed scroll member 2. However, since in the embodiment there is provided the maximum distance control mechanism that controls the gap between the frame thrust face 4*r* and the backside of the orbiting scroll member 3 to 10–20 $\mu$m, an inclined amount or separate distance can be restricted to permit the compressor operate, though not high performance. There is an advantage to widen the range of operating conditions.

Even if the orbiting scroll member 3 and the fixed scroll member 2 are covered with a surface coating which has adaptability and surface of which swells above the base material, the orbiting scroll member 3 and the fixed scroll member 2 can be assembled as long as the sum of the swells in the axial direction is smaller than the maximum distance allowed by the maximum distance control mechanism so that the members 3 and 2 will be spaced with each other.

Ports of the pressure passage 4*v* on the side of the motor chamber 62 may be open to some of communicating grooves 4*h* in the upper portion through which the gas passes. In this case, since the gas flow rate at the portions of the communication grooves 4*h* to which the ports of the pressure passage 4*v* are open is very high, the pressure in the pressure passage 4*v* becomes lower than that in the motor chamber 62. Therefore, generated is a flow of lubricating oil that flows in the seal backside space 73 from the pressure passage 4*u* and flows out from the pressure passage 4*v*. Therefore, sealing with the backside space 11 is thus kept proper due to an action of the lubricating oil abundantly supplied to completely inhibit the leakage between the seal backside space 73 and the suction system, and hence to improve the overall adiabatic efficiency.

Since the four bypass holes 2*e* and the associated bypass valves 23 are provided for constantly communicating the compression chambers 6 with the backside chamber 61 having the discharge pressure, even when fluid compression is likely to occur, the bypass valves 23 can be opened to discharge fluid to the backside chamber 61 before the pressure extremely rises. It is therefore possible to avoid the danger of damaging the wraps and hence to improve the reliability. The excessive compression can also be inhibited to make the overall adiabatic efficiency high even under the operating conditions accompanying a low pressure ratio.

Since the outer form of the shaft balance 49 is circular, viscosity losses accompanying the rotation of the shaft 12 can be reduced.

A surface coating with good conformability and lubrication performance may be provided on the bottom of the end plate 3*a* of the orbiting scroll member 3 and the entire surface of the scroll wrap 3*b* as well as the bottom of the end plate 2*a* of the fixed scroll member 2 and the entire surface of the scroll wrap 2*b*. It can be considered that such a surface coating is produced by a nitrosulphurizing process or a manganese phosphate coating process. The gap between the sides of the scroll wraps 3*b* and 2*b* and the gap between the top and the bottom of the wraps are thus made small to improve the sliding property in the contact portion between the scroll wraps 3*b* and 2*b*. It is therefore possible to reduce the internal leakage and hence friction losses. Accordingly, the performance of the compressor can also be improved. However, the performance is lowered during a period of time until the surface coating conforms to the base material, and a problem may arise when such a period is long. The following action can be taken to overcome the problem. In case the distance between the thrust face 3*d* and the reference surface 2*u* is set longer than that between the surface 9*w* opposite to the reference surface 2*u* and the slide thrust bearing 9*a* when both scroll members 2 and 3 with their surface coatings before conformed are pressed against each other, and the distance between the thrust face 3*d* and the reference surface 2*u* is set shorter than that between the surface 9*w* opposite to the reference surface 2*u* and the slide thrust bearing 9*a* when both scrolls 2 and 3 without surface coatings are pressed against each other, upon beginning of conform, the reference surface 2*u* and the surface 9*w* opposite to the reference surface 2*u* do not come into contact with each other and the top and the bottom of the scroll wraps come into contact with each other. Since the force at this time is a force to lift or push up the thrust member 9, it becomes very large, so that the surface coating conforms to the base material rapidly. Since the base materials of the scroll members do not come into contact with each other, the conform of the coating will progress to its final. As a result, the time required for conform to the base material can be reduced, i.e., the low performance period becomes short, to improve the workability.

If the surface coating has the tendency to swell above the surface of the base material and a possibility of eating the base material, by setting the distance between the thrust face 3*d* and the reference surface 2*u* longer than that between the surface 9*w* opposite to the reference surface 2*u* and the slide thrust bearing 9*a* when both scroll members 2 and 3 with surface coatings thereon are pressed against each other, and by setting the distance between the thrust face 3*d* and the reference surface 2*u* shorter than that between the surface 9*w* opposite to the reference surface 2*u* and the slide thrust bearing 9*a* when both scroll members 2 and 3 without surface coatings are pressed against each other, complicated thickness requirements are satisfied. Therefore, there is a specific advantage to be able to easily control dimensions.

Further, the surface coating may be provided on the Oldham's ring sliding surface and the Oldham's grooves 2*g* and 2*h* for sliding against the Oldham's ring 5. In this case, friction losses between the orbiting scroll member 3 and the Oldham's ring 5 can be reduced, thereby improving the overall adiabatic efficiency.

Furthermore, the entire surface of the thrust member 9 may be covered with a surface coating having good lubrication performance. It can be considered that such a surface coating film is produced by a nitrosulphurizing process or a manganese phosphate coating process. The sliding properties between the thrust face and the thrust bearing surface can thus be improved to reduce friction loses there. As a result, there is a specific advantage to be able to further improving the overall adiabatic efficiency. When using a surface coating having good conformability, the thickness of the coating is set small, e.g., to 2–3 μm. As a result, the thrust bearing surface 9*a* conforms more quickly than the top and the bottom of the scroll wraps, so that the gap between the top and the bottom after completion of conform never increases.

The scroll wraps 2*b* and 3*b* may be formed with an inviolate curve. In this case, the scroll wraps becomes easy to be worked and the workability of the compressor can be improved.

The fixed scroll member 2 and the orbiting scroll member 3 may be formed of the same material while processing the wraps 2*b* and 3*b* in the same height within an accuracy of 3 μm. In this case, since the space between the thrust bearing 9*a* and the surface 9*w* opposite to the reference surface 2*u* in the thrust member 9 is larger than the thickness of the end plate 3*a* at a position of the thrust face 3*d* of the orbiting scroll member 3, the same dimensions are secured for the gap between the wrap top of the orbiting scroll member and the wrap bottom of the fixed scroll member and the gap between the wrap bottom of the orbiting scroll member and the wrap top of the fixed scroll wrap are with an accuracy of 3 μm on the assumption that the scroll members 2, 3 and the thrust member 9 are not deformed during operation. In other words, the wrap top and the wrap bottom do not come into contact with each other even if they are deformed by such gap amount. Since the compressor is operated under various conditions, the deformation amount of the scroll members 2, 3 and the thrust member 9 is is not constant, and therefore a gap needs to be provided between the wrap top and the wrap bottom. When the fixed scroll member 2 and the orbiting scroll member 3 are formed of the same material, the two gaps, namely, the gap between the wrap top of the orbiting scroll member and the wrap bottom of the fixed scroll member and the gap between the wrap bottom of the orbiting scroll member and the wrap top of the fixed scroll member, are preferably finished with the same dimensions. By effecting selective assembling of the scroll members so that the difference between the distance between the thrust bearing 9*a* and the surface 9*w* opposite to the reference surface 2*u* in the thrust member 9, and the thickness of the end plate 3*a* at a position of the thrust face 3*d* of the orbiting scroll member 3 agrees with an optimum gap between the top and the bottom of the scroll wraps, a special advantage that mass-production of the compressor with less deviation of the performance and the reliability becomes possible.

Further, rotation preventing means may be provided in the thrust member 9. In this case, since the differential-pressure control valve 100 is not changed in position, the differential-pressure control valve 100 can be put in an optimum position. For example, when the oil supplied from the bearing is accumulated in the backside excess-suction-pressure region 99 to increase stirring losses due to the balance weight 49, the differential-pressure control valve 100 is placed in the lowermost portion of the oiling groove 9*g*. As a result, oil flowing in the backside excess-suction-pressure region 99 is accumulated by gravity on the lower surface, and the differential-pressure control valve 100 serving as a discharge hole is open there, so that the oil can be effectively discharged from the backside excess-suction-pressure region 99. As a result, the stirring loss due to the balance weight 49 is reduced to improve the overall adiabatic efficiency of the compressor.

The embodiment adopts a release mechanism in which the thrust member is movable in the axial direction. Even when the top and the bottom of the scroll wraps are brought into contact with each other under the influence of unexpected phenomena, the thrust member serving as the support member of the orbiting scroll member can be released to avoid the danger of great damage to the scroll wraps. However, any other anti-release structure, in which the thrust frame is fixed to the frame, can show the same advantages except the advantage accompanying the release action.

When the compressor of this embodiment is used for a refrigerating cycle or in the application requiring an operating range under pressure conditions shown in FIG. 9, the overall adiabatic efficiency and the reliability can be improved in a wide operating range since the excess suction pressure value can be set small in the same manner as described in the first embodiment. The advantage of using gases including R32 is the same as that in the first embodiment.

Referring next to FIGS. 19 through 23, a third embodiment of the present invention will be described. The third embodiment embodies the present invention in a non-turning release type horizontal scroll compressor. In the scroll compressor, there is provided a fixed scroll member movable in the axial direction. Discharge pressure is applied to one side of an end plate of the fixed scroll member, opposite to compression chambers, so that an attractive force is exerted there. A support member of the fixed scroll member is fixed to a frame for use as a stopper member. A backside excess-suction-pressure region is provided at a backside of an end plate of an orbiting scroll member, opposite to compression chambers. A thrust face of a frame portion provided on the backside of the orbiting scroll member is used as a support member for the orbiting scroll member within the operating pressure range required. In other words, the compressor of this embodiment receives the attractive force at the backside of the orbiting scroll member without the orbiting scroll member and the fixed scroll member pressed against each other.

Figure 19:
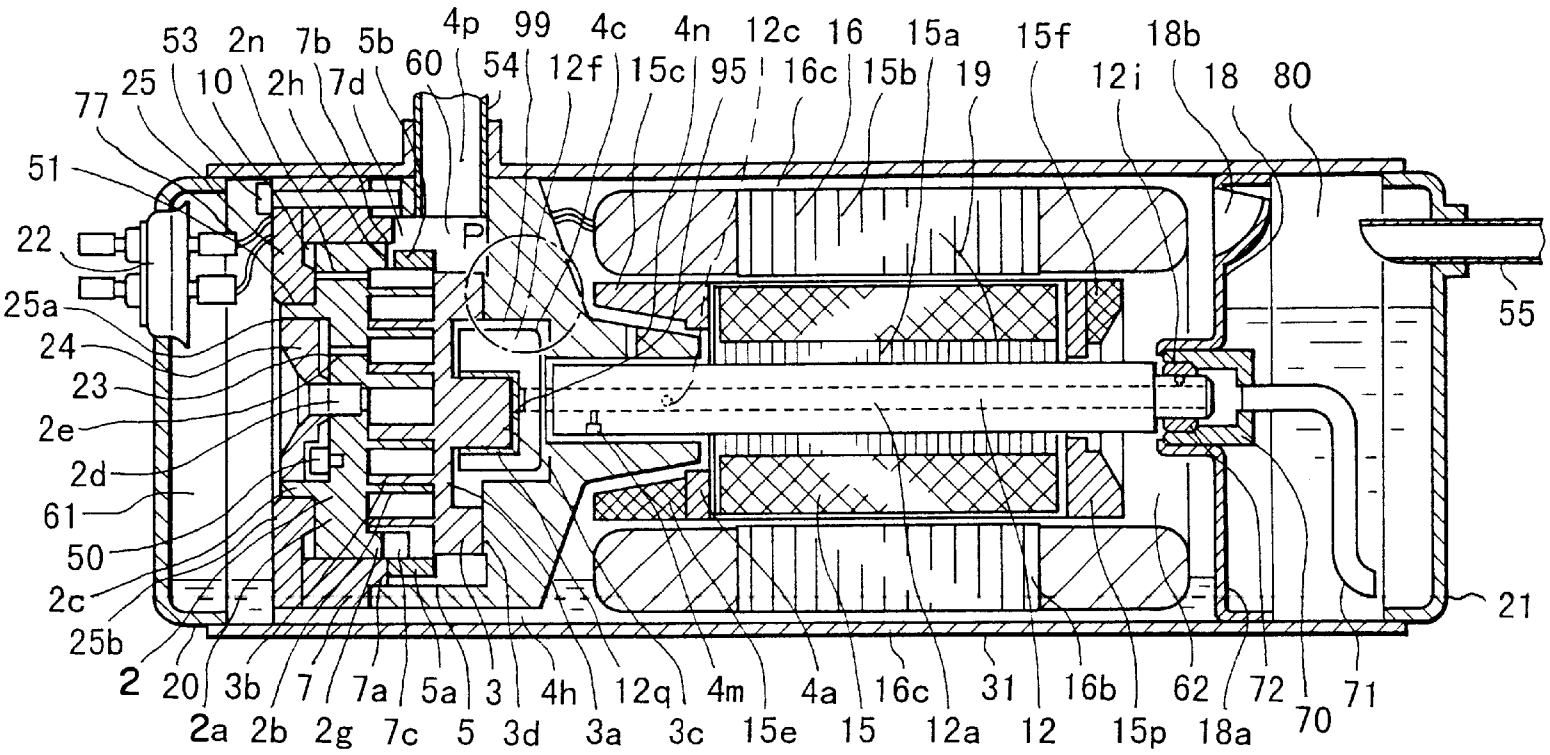
FIG. 19 is a longitudinal sectional view of a compressor according to a third embodiment.
Figure 20:
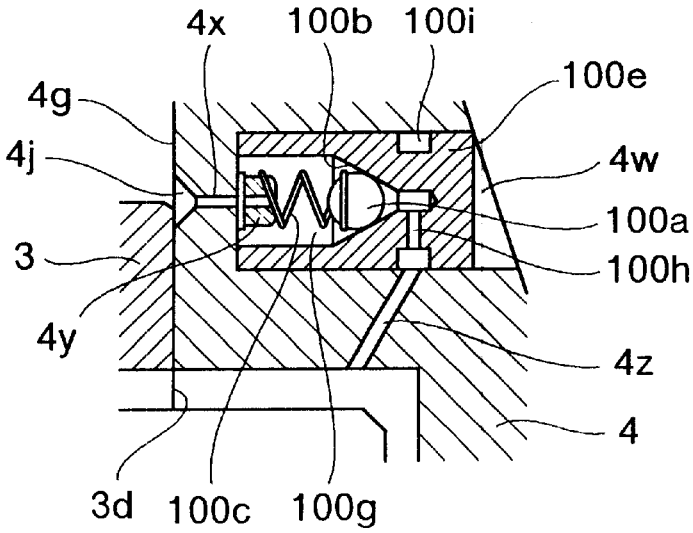
FIG. 20 is a longitudinal sectional view of a pressure-difference control valve (portion P in FIG. 19) of the third embodiment.
Figure 21:
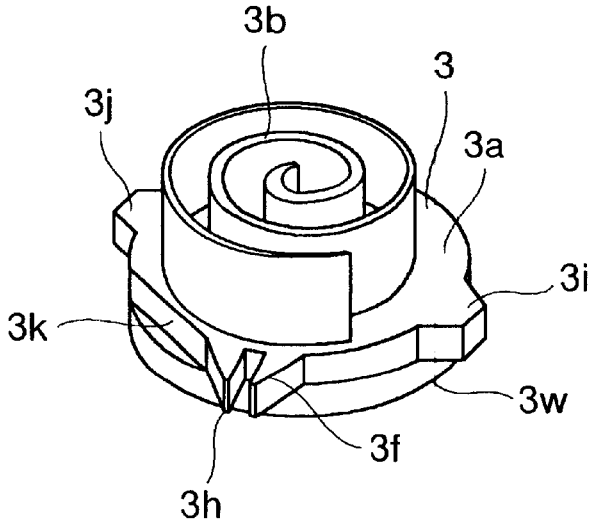
FIG. 21 is a perspective view of an orbiting scroll member of the third embodiment.
Figure 22:
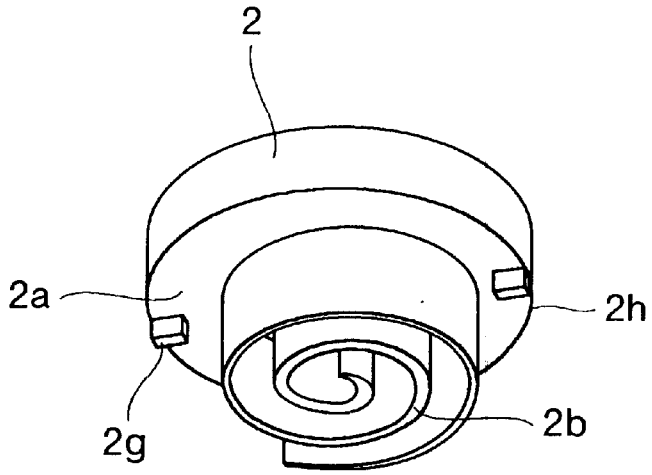
FIG. 22 is a perspective view of a fixed scroll member of the third embodiment.
Figure 23:
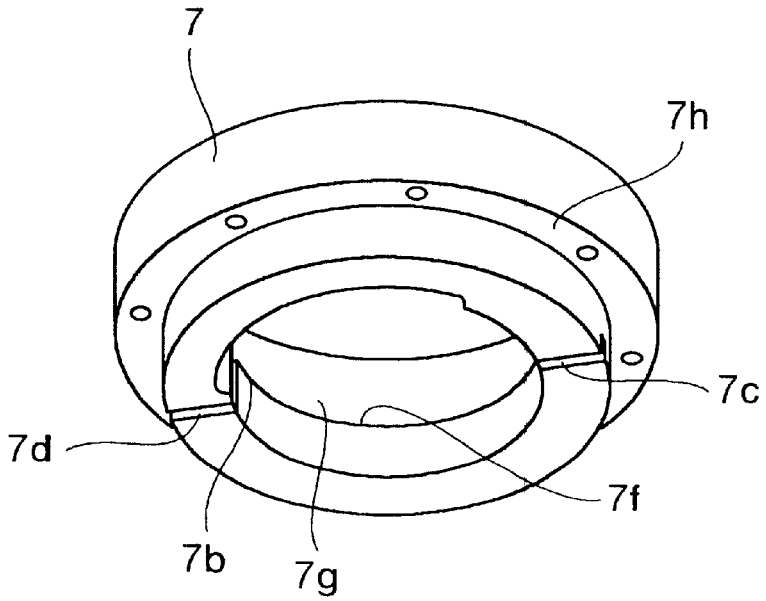
FIG. 23 is a perspective view of a stopper member of the third embodiment.

FIG. 19 is a longitudinal sectional view of the compressor, FIG. 20 is a longitudinal sectional view of a pressure-difference control valve, FIG. 21 is a perspective view of the orbiting scroll member, FIG. 22 is a perspective view of the fixed scroll member, and FIG. 23 is a perspective view of the stopper.

The construction will first be described. The embodiment is the same as the second embodiment except in that the support member of the orbiting scroll member 3 is the frame 4 fixed to the backside while the fixed scroll member is movable in the axial direction, and therefore, the detailed description will be omitted.

In the orbiting scroll member 3, scroll wrap 3*b* stands on an end plate 3*a* and a boss 3*c* is provided at the backside of the end plate 3*a*. A thrust face 3*d* is also provided in an outer peripheral portion of the backside. Oldham's projections 3*e* and 3*f* project from the outer portion of the end plate 3*a* and Oldham's grooves 3*g* and 3*h* are provided therein. Oldham's support projections 3*i* and 3*j* are also provided in the outer portion of the end plate 3*a*. The scroll wrap 3*b* is reduced in thickness gradually from the center to the outer edge except the center end and the outer end. Further, a balance notch portion 3*k* is provided for balancing the scroll wrap 3*b*. The balance notch portion 3*k* is formed by cutting the top surface of the end plate 3*a* into a straight line.

Rotation preventing grooves 7*a* and 7*b* are provided on a stopper surface 7*f*, located one step lower, of a stopper member 7, and Oldham's grooves 7*c* and 7*d* are provided below the rotation preventing grooves 7*a* and 7*b*. The rotation preventing grooves 7*a*, 7*b* and the Oldham's grooves 7*c*, 7*d* common side surfaces. Then, a rail surface 7*g* is provided as an inner surface for surrounding the stopper surface.

In the fixed scroll member 2, a scroll wrap 2*b* stands on an surface of an end plate 2*a* while a seal projection 2*c* stands at a center of a back surface of the end plate 2*a*. in the seal projection 2*c*, a discharge hole 2*d* is opened near the center and a plurality of bypass holes 2*e* are opened. A bypass valve plate 23 as a lead valve plate is then fastened with a bypass screw 50 to the bypass hole 2*e*. Further, a mean-pressure hole 2*n* is opened at the outside of the seal projection 2*c*. Rotation preventing projections 2*g* and 2*h* project from the end plate 3*a* located on the side of the compression chambers. The scroll wrap 2*b* is reduced in thickness gradually from the center to the outer edge except the center end and the outer end.

A frame 4 has a face 4*b* for fixing the stopper member at an outer peripheral portion, and a thrust face 4*g* dug inside the stopper fixing face 4*b*. A suction hole 4*p* is provided on a side of the frame 4. An oil groove 4*i* is provided on the thrust face 4*g* and an oiling hole 4*x* is provided to communicate the oil groove 4*i* with a differential-pressure valve inserting hole 4*w* which is dug from the side of the compression chambers. A second oiling hole 4*z* is opened from the side of the differential-pressure valve inserting hole 4*w* into the side of a backside chamber 4*j*. A shaft seal 4*a* and a main bearing 4*a* are provided at the center of the frame 4, while a shaft thrust face 4*c* is provided on the scroll side for receiving the shaft. A lateral hole 4*n* is opened from the side of the frame into a space between the shaft seal 4*a* and the main bearing 4*a*. Further, a plurality of communicating grooves 4*h* are provided around the circumferential surface for use as passages for gas and oil.

A differential-pressure control valve 100 is incorporated in the differential-pressure valve inserting hole 4*w* as follows. A differential-pressure spring 100*c* is press fitted onto a spring positioning projection 4*y* located at the bottom of the differential-pressure valve inserting hole 4*w*, and a globular valve body 100*a* is mounted in a cylindrical case 100*e* provided with a valve dig 100*g* having a tapered valve seal surface 100*b*. In such an arrangement, the case 100*b* is press fitted into, bonded or welded to the differential-pressure valve inserting hole 4*w*. At this time, a case groove 100*i* having a case oiling hole 100*h* which is opened from the bottom of the valve dig 100*g* to the case groove 100*i* comes to an opening portion of the second oiling hole 4*z*.

The differential-pressure valve spring 100*c* is thus compressed to press the valve body 100*a* against the valve seal surface 100*b*. Since the pressing force determines a value of excess suction pressure, factors for determining the magnitude of the pressing force, i.e., the depth of the valve dig 100*g*, the diameter of the valve body 100*a*, and the spring constant, the natural length and the spring diameter of the differential-pressure valve spring 100*c*, must be managed with proper accuracy.

Alternatively, the differential-pressure control valve 100 may be formed by setting the inside diameter of the differential-pressure valve inserting hole 4*w* larger than the outward form of the valve case 100*e* and bonding the valve case 100*e* in a position when the pressing force becomes a normal value. In this technique, the factors such as the size of each portion and the spring constant do not need to be managed precisely, so that the productivity can be improved. In both cases, a portion between the differential-pressure valve inserting hole 4*w* and the valve case 100*e* must be sealed completely at the end of the assembly.

In the Oldham's ring 5, stopper projections 5*a* and 5*b* are provided on one face while projections 5*c* and 5*d* (not shown) are provided on the other face.

An outer cover 25 is provided with a cover weight 25*a* at an upper portion of an inner periphery and a ring groove 25*b* at a lower portion of the inner periphery. A seal ring 51, made of a heat resisting, soft material, is inserted in the ring groove 25.

A shaft 12 is provided with a shaft oiling hole 12*a*, a main bearing oiling hole 12*b*, a shaft seal oiling hole 12*c* and a sub-bearing oiling hole 12*i*. A bearing holder 12*f* with its diameter being larger than the shaft 12 is located at the upper portion of the shaft 12, and a bearing 12*q* is press fitted into the bearing holder 12*f* at an eccentric position.

With a rotor 15, a non-magnetized permanent magnet 15*a* is built in stacked steel plates 15*a*, and an upper balance weight 15*c* is fixed on the upper surface of the stacked steel plates 15*a*. The balance weight 15*c* is formed into a cylindrical shape by fixing an upper correcting balance weight 15*e* to the upper balance weight 15*c*. The upper correcting balance weight 15*e* is made of a material having a specific gravity smaller than that of the upper balance weight 15*c*. On the other hand, a lower balance weight 15*p* is fixed on the lower surface of the stacked steel plates 15*a*. The balance weight 15*p* is formed into a cylindrical shape by fixing a lower correcting balance weight 15*f* to the lower balance weight 15*p*. The lower correcting balance weight 15*f* is made of a material having a specific gravity smaller than that of the lower balance weight 15*p*. With materials, zinc or yellow brass for the balance weights 15*c* and 15*p* and aluminum alloy for the correction balance weights 15*e* and 15*f* may be used. The correction balance weights 15*e* and 15*f* may be fixed directly to the stacked steel plates 15*a*.

A stator 16 is formed with a plurality of stator grooves 16*c* at the circumference of stacked steel plates 16*b* for use as passages for compressible gas and oil. The stator grooves 16*c* may be replaced by lateral holes opened into the inside of the stacked steel plates 16*b*.

The above elements are assembled as follows. The shaft 12 is first inserted in the main bearing 4*a* of the frame 4 and the rotor 15 is fixed. The orbiting scroll member 3 is then incorporated by inserting the boss 3*c* into the bearing 12*q* and mounting the thrust face 3*d* on the thrust face 4*g* of the frame 4. The backside excess-suction-pressure region 99 is thus formed at the backside of the orbiting scroll member 3. The Oldham's ring 5 is mounted on the end plate 3*a*, on which the scroll wrap stands, while inserting the projections 5*c*, 5*d* into the Oldham's grooves 3*g*, 3*h*, respectively. Then, the stopper member 7 is mounted on the upper surface of the frame while inserting the projections 5*a*, 5*b* into the Oldham's grooves 7*c*, 7*d*, respectively. A suction chamber 60 is thus formed around the orbiting scroll member 3.

The fixed scroll member 2 is mounted on the thrust face 7*f* while inserting the rotation preventing projections 2*g*, 2*h* into the rotation preventing grooves 7*a*, 7*b*, respectively. The outer circumference of the fixed scroll member 2 and the inner circumference of the rail surface 7*g* are loose fitted with a difference in diameter of about 5 μm. The outer cover 25 is then mounted on the stopper member 7 so that the seal ring 51 put in the ring groove 25*b* can slide on the outer surface of the seal projections 2*c*. The cover weight 25*a* provided in the inner periphery of the outer cover 25 prevents the center cover 25 from coming off the inner periphery of the seal projection 2*c*. The stopper member 7 and the outer cover 25 are then fastened to the frame 4 with a cover screw 53. An upper surface chamber 10 is thus formed between the fixed scroll member 2 and the outer cover 25.

The above assembly is inserted into a cylindrical casing 31 into which the stator 16 has been shrinkage-fitted, and tack-welded to the side of the frame 4. A suction pipe 54 is inserted in and fixed to the suction hole 4*p*. An upper casing 20 is also welded to the cylindrical casing 31. A backside chamber 61 is thus formed above the outer cover 25.

A bearing housing 70 on which a spherical bearing 72 has been mounted and an oil feed pipe 71 has been welded is fixed to the center of the bearing support plate 18. The bearing support plate 18 is inserted and fixed to the cylindrical casing 31 so that an end of the shaft 12 is inserted into a cylindrical hole of the spherical bearing 72. A motor chamber 62 is thus formed between the frame 4 and the bearing support plate 18. A bottom casing 21 with a discharge pipe welded thereto is welded to the cylindrical casing 31, thus forming an oil storage chamber 80. Under such an arrangement, current is supplied to the stator 16 to magnetize the permanent magnet 15*b* thereby forming a motor. At the final stage, lubricating oil is supplied.

In operation, since compressible gas and oil flows in the same manner as in the second embodiment, the description will be omitted. The release action of the fixed scroll member is the same as that of the thrust member in the second embodiment, and the description will be omitted as well.

In this example, since the turning holder 12*f* has a cylindrical shape, the embodiment shows a special advantage of further reducing the viscosity loss accompanying the rotation of the turning holder 12*f*.

Since the center cover 24 and the outer cover 25 form a layer of gas downwardly, the embodiment shows a special advantage of preventing heat due to hot discharge gas in the upside chamber 61 from transferring to the compression chambers 6. The center cover 24 and the outer cover 25 also acts to insulate impact sound when the bypass valve is opened or closed.

The center cover 24 may be made of a material having a coefficient of thermal expansion larger than that of the end plate 2*a*, and the outer edge of the center cover 24 and the inner edge of the seal projection 2*c* may be fitted with a maximum clearance of about 10 μm. In this case, the center cover 24 expands due to a rise of temperature during operation and the seal projection 2*c* is deformed in the expanding direction. As a result, the upside of the end plate 2*a* extends relative to the underside, so that a convexity deformation appears on the end plate 2*a*. It is therefore possible to avoid a contact between the top and the bottom of the wraps due to high temperature at the center of the scroll wraps, and hence to improve the efficiency and the reliability of the compressor. For example, the float scroll member 2 may be cast-iron, and the center cover 24 may be made of yellow brass, zinc or aluminum alloy, preferably of aluminum alloy having a high Young's modulus with silicon content of about 10 to 30%.

The tip of the feed oil pipe 71 is provided on the side opposite to the oil supply hole 18*a*, so that the danger that the compressed gas comes in the feed oil pipe 71 is prevented, thereby improving the reliability.

The port of discharge pipe is open to the upper portion and therefore, the oil bubbled in the oil storage chamber 80 is restricted to be discharged, so that a less oil discharge and reliable compressor can be provided.

Referring next to FIGS. 24 through 29, a fourth embodiment will be described. The fourth embodiment embodies the present invention in a non-turning float type vertical scroll compressor. In the scroll compressor, there is provided a fixed scroll member movable in the axial direction. A backside excess-suction-pressure region is provided on one side of an end plate opposite to the side of compression chambers. An orbiting scroll member is used as a support member for a fixed scroll member within operating pressure conditions required. In other words, the compressor is constructed such that the fixed scroll member is pressed against the orbiting scroll member.

Figure 24:
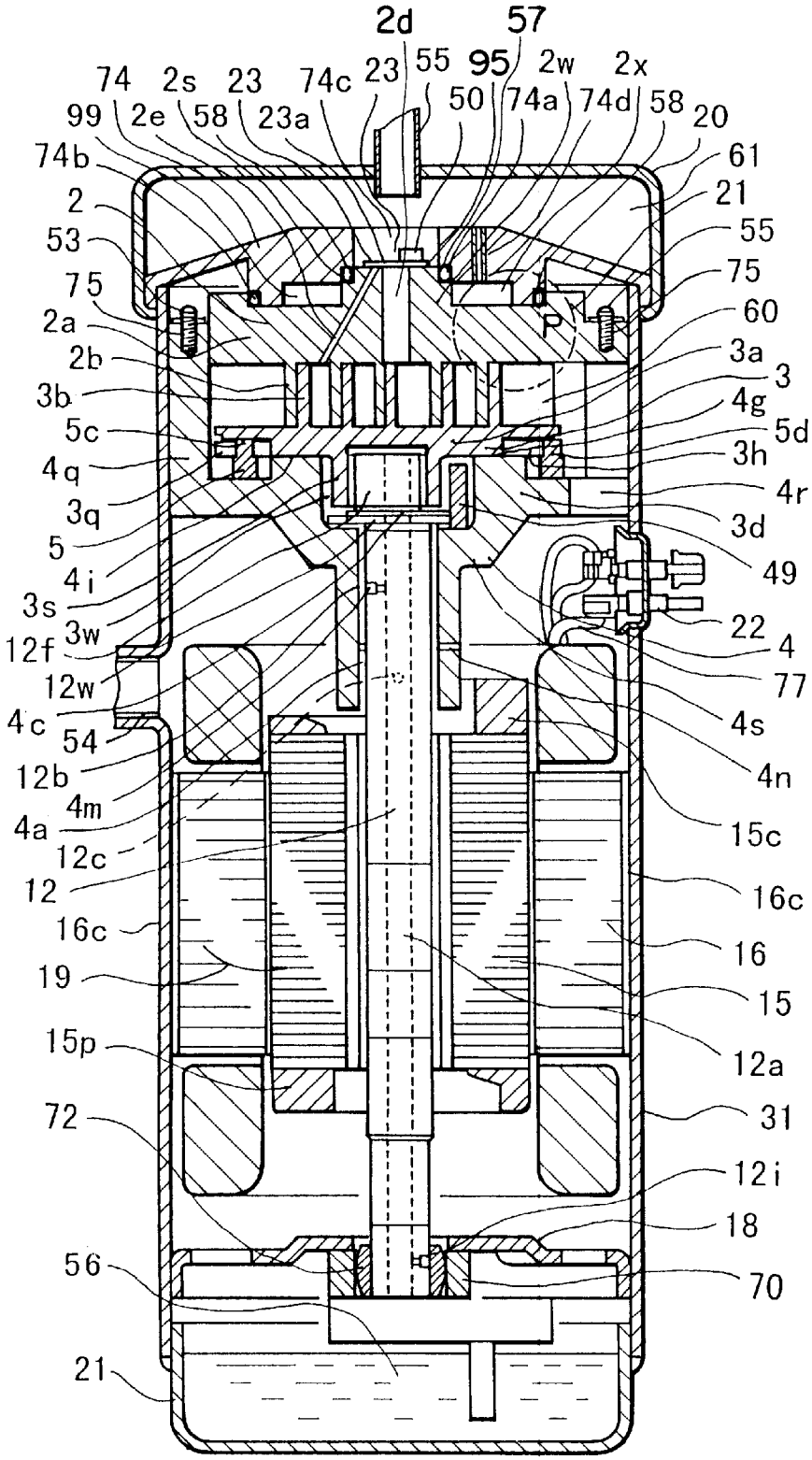
FIG. 24 is a longitudinal sectional view of a compressor according to a fourth embodiment.
Figure 25:
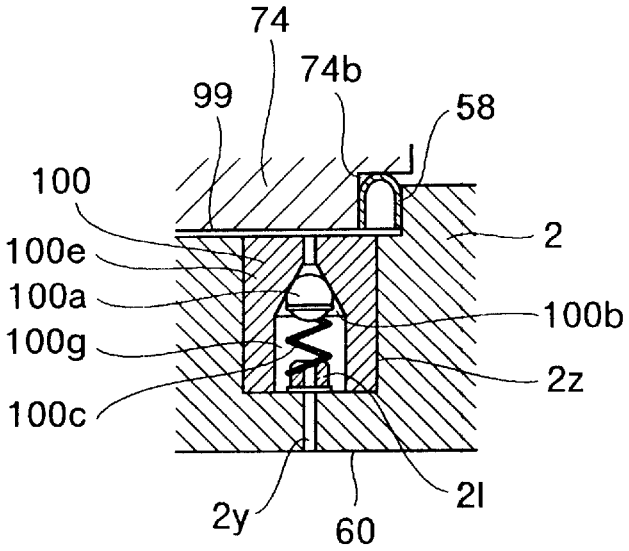
FIG. 25 is a longitudinal sectional view of a pressure-difference control valve (portion P in FIG. 24) of the fourth embodiment.
Figure 26:
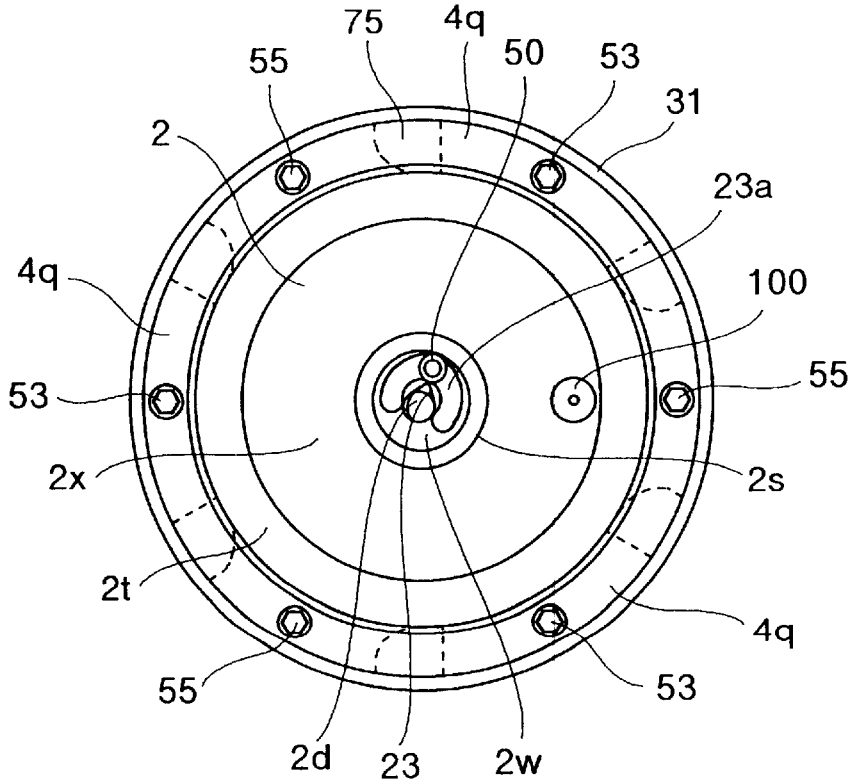
FIG. 26 is a top view of the compressor of the fourth embodiment in which a pressure diaphragm is removed.
Figure 27:
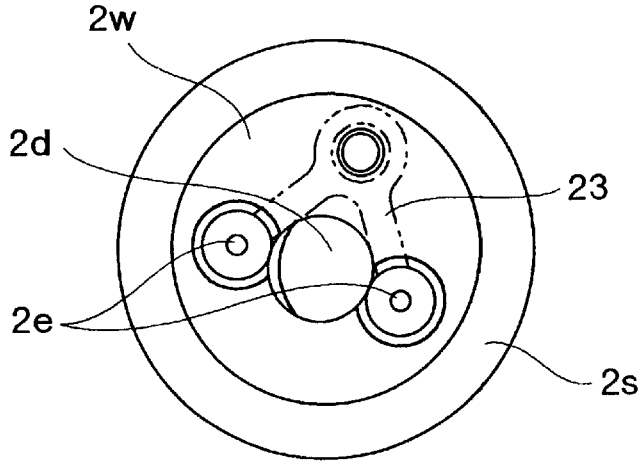
FIG. 27 is a top view showing a central portion of the fixed scroll member of the fourth embodiment.
Figure 28:
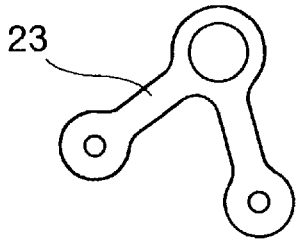
FIG. 28 is a top view of a bypass valve of the fourth embodiment.
Figure 29:
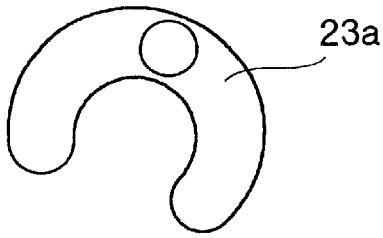
FIG. 29 is a top view of a retainer of the fourth embodiment.

FIG. 24 is a longitudinal sectional view of the compressor; FIG. 25 is a longitudinal sectional view of a pressure-difference control valve; FIG. 26 is a top view of the compressor in which a pressure diaphragm is removed; FIG. 27 is a top view showing a central portion of the fixed scroll member; FIG. 28 is a top view of a bypass valve; and FIG. 29 is a top view of a retainer.

The construction will first be described.

In an orbiting scroll member 3, a scroll wrap 3*b* stands on an end plate 3*a*. A bearing holder 3*s* into which a bearing 3*w* is press fitted and Oldham's grooves 3*g*, 3*h* are arranged at the backside. A thrust face 3*d* is also provided at the backside.

In a fixed scroll member 2, a scroll wrap 2*b* stands on an end plate 2*a* and a center base 2*w* is provided at the backside. A discharge hole 2*d* and a plurality of bypass holes 2*e* are opened into the upper surface of the center base 2*w*. A bypass valve plate 23 as a lead valve plate is then fastened with a bypass screw 50 to the bypass holes 2*e*. A seal groove 2s is provided around the circumference of the center base 2*w*. An outer circumference projection 2*t* is provided near the outer edge of the backside, while a backside concave portion 2*x* is provided between the outer circumference projection 2*t* and the center base 2*w*. A differential-pressure valve inserting hole 2*z* is dug near the circumference of the backside concave portion 2*x*, and a discharge path 2*y* is opened from the bottom of the hole 2*z* into an outer circumference portion of the scroll wrap side which serves as a suction chamber. A spring positioning projection 21 is provided at the bottom of the differential-pressure valve inserting hole 2*z*.

A differential-pressure control valve 100 is incorporated in the differential-pressure valve inserting hole 2*z* as follows. A differential-pressure spring 100*c* is press fitted onto a spring positioning projection 21 located at the bottom of the differential-pressure valve inserting hole 2*z*, and a globular valve body 100*a* is mounted in a cylindrical case 100*e* provided with a valve dig 100*g* having a tapered valve seal surface 100*b*. In such an arrangement, the differential-pressure control valve 100 is press fitted into, bonded or welded to the differential-pressure valve inserting hole 2*z*. The differential-pressure control valve 100 is thus formed.

The differential-valve spring 100*c* is compressed to press the valve body 100*a* against the valve seal surface 100*b*. Since the pressing force determines a value of excess suction pressure, factors for determining the magnitude of the pressing force, i.e., the depth of the valve dig 100*g*, the diameter of the valve body 10*a*, and the spring constant, the natural length and the spring diameter of the differential-pressure valve spring 100*c*, must be managed with proper accuracy.

Alternatively, the differential-pressure control valve 100 may be formed by setting the inside diameter of the differential-pressure valve inserting hole 2*z* larger than the outward form of the valve case 100*e* and bonding the valve case 100*e* in a position in which the pressing force becomes a normal value. In this technique, the factors such as the size of each portion and the spring constant do not need to be managed precisely, so that the productivity can be improved. In both cases, a portion between the differential-pressure valve inserting hole 2*z* and the valve case 100*e* must be sealed completely at the end of the assembly.

A frame 4 has three scroll mounting projections 4*q* for fixing the fixed scroll member 2 through plate-like scroll clamp springs 75 at an outer circumference portion. A sliding thrust face 4*g* and Oldham's grooves 4*e*, 4*f* are provided inside the scroll clamp projections 4*q*. A plurality of suction grooves 4*r* are also provided in the outer circumference portion of the frame 4. Annular or radial linear oil grooves 4*i* are provided to the sliding thrust bearing 4*g*.

A shaft seal 4*a* and a main bearing 4*a* are provided at the center, while a shaft thrust face 4*c* is provided on the scroll side for receiving the shaft. An oil discharge path 4*s* is opened from the lowermost portion of the upper surface of the frame 4 into the lower surface. A lateral hole 4*n* is also opened from the side of the frame into a space between the shaft seal 4*a* and the main bearing 4*m*.

In the Oldham's ring 5, projections 5*a* and 5*b* for frame are provided on one face while projections 5*c* and 5*d* (not shown) for an orbiting scroll are provided on the other face.

A pressure partition plate 74 is provided with a discharge opening 74*c* at the center, an inner circumference seal groove 74*a* on the lower portion of the inner circumference portion and an outer circumference seal groove 74*b* near the center of the lower surface. A discharge backside passage 74*d* having a throat for communicating the lower surface and the upper surface between the two seal grooves is provided. The discharge backside passage 74*d* is formed by press fitting a separate piece having a small bore.

A shaft 12 is formed with a shaft oiling hole 12*a*, a main bearing oiling hole 12*b*, a shaft seal oiling hole 12*c* and a sub-bearing oiling hole 12*i*. A bearing holder 12*w* with its diameter being larger than the shaft 12 is located at the upside of the shaft 12, and a shaft balance 49 is press fitted into the bearing holder 12*w*. An eccentric portion 12*f* is provided on the bearing holder 12*w*.

The rotor 15 and the stator 16 are constructed in the same manner as in the first embodiment and the description is omitted.

The above elements are assembled as follows. The shaft 12 is first inserted in the main bearing 4*a* of the frame 4 and the rotor 15 is fixed. The Oldham's ring 5 is mounted by inserting the projections 5*a*, 5*b* of the Oldham's ring 5 into the Oldham's grooves 4*f*, 4*e*, respectively. The orbiting scroll member 3 is then incorporated such that the bearing 3*w* is inserted into the eccentric portion 12*f* of the shaft 12, the Oldham's grooves 3*g*, 3*h* are fitted on the projections 5*c*, 5*d* of the Oldham's ring 5, and the thrust face 3*d* is mounted on the thrust bearing 4*g* of the frame 4. The fixed scroll member 2 to which the scroll clamp springs 75 have been fastened with three spring screws 55 is mounted on the upper surface of the frame clamp portion 4*q* of the frame 4 so that the scroll wraps can be meshed with each other. In such an arrangement, the fixed scroll member 2 is fixed to the frame 4 with a cover screw 53.

The above assembly is inserted into a cylindrical casing 31 and tack-welded to the side of the frame 4. The casing 31 is constructed such that the stator 16 is shrinkage-fitted or press fitted, and the suction pipe 54, a bearing support plate 18 and a hermetic terminal 22 are welded. The rotor 25 and the stator 16 thus form a motor 19.

A bearing housing 70 is so incorporated that one end of the shaft 12 projecting from a central hole of the bearing support plate 18 will be inserted into a cylindrical hole of a spherical bearing 72 mounted in the bearing housing 70. The bearing housing 70 is moved while detecting the rotating torque of the shaft 12 to find a position in which the rotating torque is minimized, and spot-welded at the position to the bearing support plate 18. An oiling pump is provided on the lower surface of the bearing housing 70 for feeding oil to the shaft oiling hole 12*a*. The frame 4 and the bearing support plate 18 thus define a motor chamber 62 between them. A bottom casing 21 is then welded to the cylindrical casing 31 to form an oil storage chamber 80.

The cylindrical casing 31 is covered with the pressure partition plate 74 while inserting an inner seal 57 and an outer seal 58 into the inner seal groove 74*a* and the outer seal groove 74*b* of the pressure partition plate 74, respectively. A backside excess-suction-pressure region 99 of the fixed scroll member 2 is then provided between the inner seal 57 and the outer seal 58 on the upper surface of the fixed scroll member 2. An upper casing 20 with a discharge pipe 55 welded thereto is overlaid thereon and welded. An inside region of the inner seal 57 on the upper surface of the fixed scroll member 2 becomes a backside discharge pressure region 95 of the fixed scroll member 2. A backside chamber 61 for the fixed scroll is formed between the pressure partition plate 74 and the upper casing 20.

The bearing support plate 18 is inserted in and fixed to the cylindrical casing 31 by fixing the bearing housing 70, on which the spherical bearing 72 has been mounted and a oil feed pipe 71 has been welded, at the center and inserting the shaft 12 into the cylindrical hole of the spherical bearing 72. Under such an arrangement, current is supplied to the stator 16 and the permanent magnets 15*b* in the rotor 15 are magnetized, so that the motor 19 is formed. At the final stage, lubricating oil is supplied.

Next, the operation will be described.

The gas sucked in the suction chamber 60 through the suction pipe 54 is compressed in the compression chambers 6 due to rotational motion of the orbiting scroll member 3, and discharged from the discharge hole 2*d* to the backside chamber 61 located above the fixed scroll member 2. The gas discharged flows in the motor chamber 62, cools the motor, isolates lubricating oil contained in the gas and gets out of the discharge pipe 55 to the outside of the compressor.

Although the fixed scroll member 2 receives a force to separate from the orbiting scroll member 3 under the gas pressure in the compression chambers 6, it is pressed to the orbiting scroll member 3 due to an attractive force under the pressure from the backside excess-suction-pressure region 99 and the backside discharge pressure region 95. The energizing force of the fixed scroll member 2 is thus given from the orbiting scroll member. On the other hand, since any attractive force is not exerted to the orbiting scroll member 3, it obtains an energizing force from the sliding thrust bearing of the backside. As a result, the compression can be maintained without extending the gap between the wrap top and the wrap bottom of the scroll members.

The pressure control method for the backside excess-suction-pressure region 99 is as follows. The discharge pressure is introduced from the discharge system through the backside passage 74*d* accompanying the throat, and controlled by the differential-pressure control valve 100. The pressure control method of the embodiment is almost the same as that in the above embodiment except in that in the above embodiment the pressure introduction is carried out by an action of the compressible gas and the oil passed through the bearing. In the embodiment, the compressor can be designed by taking into account only the pressure introduction to the excess suction pressure region 99, so that an optimum design becomes possible. Since the bypass valve is provided in the same manner as in the above embodiments, the overall adiabatic efficiency and the reliability of the compressor can be further improved in a wide operating range.

Further, since the axial project area of the backside discharge area 95 is set between the maximum and the minimum of the sum of the project area viewed from the axial direction of a discharge chamber defined by both end plates communicating with the discharge system at compression operating time at which the control bypass does not communicate the compression chambers with the discharge system, and half the top areas of both scroll wraps that form a boundary between the discharge chamber and the compression chambers surrounding the discharge chamber, the excess suction pressure value can be set very small, thereby improving the overall adiabatic efficiency and the reliability in a wide operating range.

The oil accumulated on the bottom of the compressor is fed by the oiling pump 56 to the main bearing 4*a* through the lateral oiling hole 12*b* as well as to the bearing 12*c* through the shaft oiling hole 12*a*. After the oil enters the backside chamber 11, part of the oil flows in the suction chamber 60 through the oil groove 4*i* while lubricating the sliding thrust bearing 4. The remaining oil flows in the motor chamber 62 through the oil discharge path 4*s* to be returned to the bottom of the compressor.

Since the pressure partition plate 74 forms a layer of gas downwardly, the embodiment shows a special advantage of preventing heat due to hot discharge gas in the backside chamber 61 from transferring to the compression chambers 6.

For the pressure introduction to the backside excess-suction-pressure region 99, minute grooves may be provided in the inner seal 57, instead of the discharge backside passage 74*d*. In this case, the sealing properties are reduced and a flow of the leakage from the backside chamber 61 is used.

Figure 30:
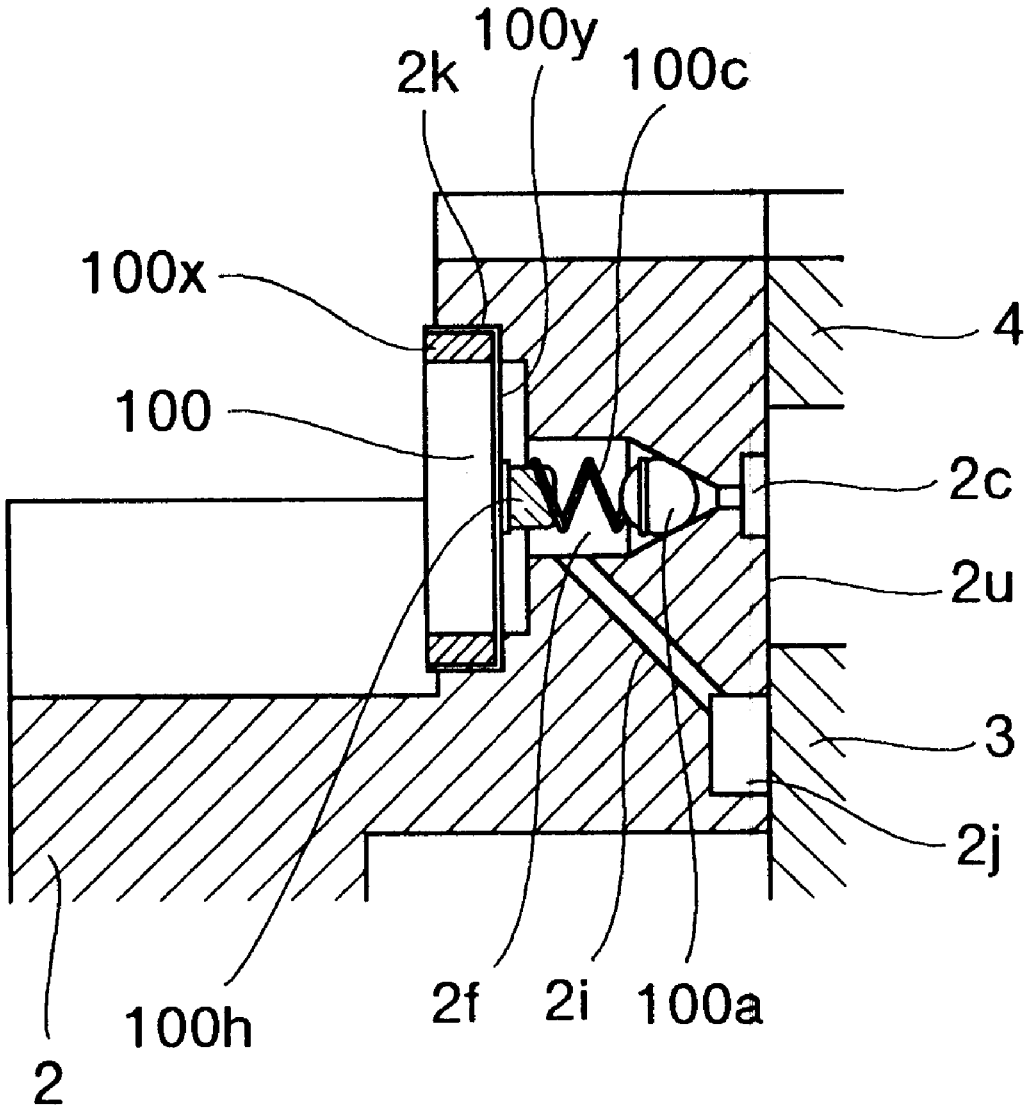
FIG. 30 is a longitudinal sectional view of a pressure-difference control valve (portion P in FIG. 1) of a fifth embodiment.

Referring to FIG. 30, a fifth embodiment will be described. The fifth embodiment embodies the present invention in a turning float type horizontal scroll compressor. Since the embodiment is the same as the first embodiment except in that the valve cap of the pressure-difference control valve 100 becomes a spring valve cap 100*y* having elasticity and a cap weight 100*x* provided for fixing the cap 100*y*, the description of the other portions will be omitted.

Since the valve cap has a spring property, the spring valve cap 100*y* is pushed out and displaced toward the valve hole 2*f* during operation under high discharge pressure. Consequently, the difference-pressure valve spring 100*c* is pressed and shrunk to increase a pressing force to press the valve body 100*a* to the valve seal surface 2*j*, and hence the excess suction pressure value becomes large. When the axial project area of the backside discharge pressure region 95 becomes smaller than an optimum value due to restrictions on the design of the bearing for orbiting, the excess suction pressure value must be set much larger during operation under high discharge pressure. When excess suction pressure value is made large as the discharge pressure increases, the excess suction pressure value does not be excessive even under the conditions of low discharge pressure, so that the overall adiabatic efficiency and the reliability can be further more improved in a wide operating range.

As described above, the present invention can provide a scroll compressor which is easy to use and have high overall adiabatic efficiency and reliability in a wide pressure operating range.

What is claimed is:

1. A scroll compressor which includes an orbiting scroll, a fixed scroll meshed with the orbiting scroll, a back-pressure chamber provided at the backside of the orbiting scroll, a path for introducing fluid into the back-pressure chamber, a communication path between the back-pressure chamber and a suction pressure region, and means for opening and closing the communication path to keep a difference between the pressure in the back-pressure chamber and the suction pressure constant, the scroll compressor comprising: a discharge port; a communication hole communicating a compression chamber, which is defined by said orbiting scroll and said fixed scroll and is not communicated with a discharge port, with an outside space outside said compression chamber; a discharged-side space into which the fluid flows from the discharge port; a space interconnecting said outside space and said discharged-side space; and means provided in said communication hole for opening and closing said communication hole.

2. A scroll compressor as set forth in claim 1, wherein said space interconnecting said outside space and said discharged-side space is a backside chamber provided at the backside of said fixed scroll.

3. A scroll compressor which includes an orbiting scroll member having an end plate and a spiral scroll wrap provided on the end plate; an axially movable fixed scroll member having an end plate and a spiral scroll wrap provided on the end plate, which is meshed with the orbiting scroll member; attractive force applying means for applying an attractive force to said fixed scroll member, the attractive force acting to attract the end plates of both scroll members against a pull-off force to separate the end plates of both scroll members under the influence of pressure of fluid in compression chambers defined by both scroll members meshed with each other; a scroll support member for receiving a reaction force determined by a difference between the attractive force and the pull-off force; a suction system for introducing fluid into the compression chambers; and a discharge system for discharging the compressed fluid from the compression chambers to the outside, said scroll compressor comprising a control bypass for communicating the compression chambers with said discharge system when the pressure in the compression chambers is higher than discharge pressure in said discharge system, said attractive force applying means applying pressure which is higher by a constant value than suction pressure in the suction system to a backside excess-suction-pressure region provided at a backside of said fixed scroll.

4. A scroll compressor as set forth in claim 3, wherein portion of said attractive force applying means is provided with a backside discharge pressure region for applying the discharge pressure to the backside of the end plate of the scroll member to which a backside excess-suction-pressure region is provided.

5. A scroll compressor as set forth in claim 4, wherein the area of said backside discharge pressure region is set between the maximum and the minimum of the sum of the project area viewed from the axial direction of a discharge chamber defined by both end plates communicating with said discharge system at compression operating time at which said control bypass does not communicate the compression chambers with said discharge system, and half the top areas of both scroll wraps that form a boundary between the discharge chamber and the compression chambers surrounding the discharge chamber.

6. A scroll compressor as set forth in claim 3, wherein the pressure in said backside excess-suction-pressure region is means for controlling a pressure difference between said backside excess-suction-pressure region and the suction pressure to a constant value within a tolerance of about 20% of the suction pressure, the constant value being applied to a backside discharge passage accompanying a thrast and provided between said discharge system and the backside excess-suction-pressure region, a backside suction passage provided between said backside excess-suction-pressure region and said suction system and said backside excess-suction-pressure region in the backside suction passage.

7. A scroll compressor as set forth in claim 3, wherein said pressure-difference control means has the tendency to increase the constant value corresponding to the difference between said backside excess-suction-pressure region and said suction system as the discharge pressure increases. higher than the discharge pressure in said discharge system.

8. A scroll compressor which includes an orbiting scroll member having an end plate and a spiral scroll wrap provided on the end plate; an axiall movable fixed scroll member having an end plate and a spiral scroll wrap provided on the end plate, which is meshed with the orbiting scroll member; attractive force applying means for applying an attractive force to said fixed scroll member, the attractive force acting to attract the end plates of both scroll members against a pull-off force to separate the end plates of both scroll members from each other under the influence of pressure of fluid in compression chambers defined by both scroll members meshed with each other; a scroll support member for receiving a reaction force determined by a difference between the attractive force and the pull-off force; a suction system for introducing fluid into the compression chambers; and a discharge system for discharging the compressed fluid from the compression chamber to the outside, wherein said orbiting scroll member is used for said scroll support member of said fixed scroll member, said attractive force applying means applies pressure to a backside of said fixed scroll, the pressure to be applied being higher by a constant valve than suction pressure in the suction system, and a control bypass is provided for communicating the compression chambers with said discharge system when the pressure in the compression chambers is higher than the discharge pressure in said discharge system.

9. A scroll compressor as set forth in claim 8, wherein said attractive force applying means is provided with a backside discharge pressure region for applying the discharge pressure to the backside of the end plate of the scroll member to which said backside excess-suction-pressure region is provided.

10. A scroll compressor as set forth in claim 9, wherein the area of said backside discharge pressure region is set between the maximum and the minimum of the sum of the project area viewed from the axial direction of a discharge chamber defined by both end plates communicating with said discharge system at compression operating time at which said control bypass does not communicate the compression chambers with said discharge system, and half the top areas of both scroll wrgps that form a boundary between the discharge chamber and the compression chambers surrounding the discharge chamber.

11. A scroll compressor as set forth in claim 8, wherein the pressure in said backside excess-suction-pressure region is means for controlling a pressure difference between said backside excess-suction-pressure region and the suction pressure to a constant value within a tolerance of about 20% of the suction pressure, the constant value being applied to a backside discharge passage accompanying a throat and provided between said discharge system and the backside excess-suction-pressure region, a backside suction passage provided between said backside excess-suction-pressure region and said suction system and said backside excess-suction-pressure region in the backside suction passage.

12. A scroll compressor as set forth in claim 8, wherein said pressure-difference control means has the tendency to increase the constant value corresponding to the difference between said backside excess-suction-pressure region and said suction system as the discharge pressure increases.

13. A scroll compressor comprising:

an orbiting scroll;

a fixed scroll meshed with the orbiting scroll;

a compression chamber defined by the meshed orbiting and fixed scrolls;

a suction pressure region from which fluid to be compressed is introduced into the compression chamber;

a discharge port for discharging compressed fluid;

a discharge pressure chamber communicating with the discharge port;

a back-pressure chamber provided at a back side of the orbiting scroll;

a communication path communicating the back-pressure chamber with the suction pressure region;

a back-pressure control valve regulating flow through the communication path depending on a pressure difference between back-pressure in the back-pressure chamber and suction pressure in the suction pressure region;

a bypass hole communicating a compression chamber, which is not communicated with the discharge port, with the discharge-pressure chamber; and a bypass valve regulating flow through the bypass hole to the discharge-pressure chamber.

14. A scroll compressor according to claim 13, wherein said back-pressure control valve opens said communication path when the pressure difference between the back-pressure and the suction pressure becomes larger than a predetermined pressure difference in response to performance of said bypass valve.

* * * * *